US010107053B2

(12) United States Patent
Bansal et al.

(10) Patent No.: US 10,107,053 B2
(45) **Date of Patent: *Oct. 23, 2018**

(54) THREE-WAY FLOW SUB FOR CONTINUOUS CIRCULATION

(71) Applicant: Weatherford Technology Holdings, LLC, Houston, TX (US)

(72) Inventors: Ram K. Bansal, Houston, TX (US); Joe Noske, Houston, TX (US); Miroslav Mihalj, Houston, TX (US); Bill Menard, Spring, TX (US); Thomas F. Bailey, Abilene, TX (US); David Pavel, Kingwood, TX (US); Gerald Wes Don Buchanan, Calgary (CA); Geoff George, Magnolia, TX (US); David Vieraitis, The Woodlands, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 245 days.

This patent is subject to a terminal disclaimer.

(21) Appl. No.: 15/150,464

(22) Filed: May 10, 2016

(65) Prior Publication Data

US 2016/0281448 A1 Sep. 29, 2016

Related U.S. Application Data

(63) Continuation of application No. 13/596,987, filed on Aug. 28, 2012, now Pat. No. 9,353,587.

(Continued)

(51) Int. Cl.

| | |
|---|---|
| ***E21B 21/08*** | (2006.01) |
| ***E21B 21/10*** | (2006.01) |
| ***E21B 34/12*** | (2006.01) |

(52) U.S. Cl.
CPC ..... *E21B 21/08* (2013.01); *E21B 21/10* (2013.01); *E21B 34/12* (2013.01)

(58) Field of Classification Search
CPC ..... E21B 21/08; E21B 21/10; E21B 34/12
See application file for complete search history.

(56) References Cited

U.S. PATENT DOCUMENTS

| | | | |
|---|---|---|---|
| 916,268 | A | 3/1909 | Cameron |
| 1,491,986 | A | 4/1924 | Greene |

(Continued)

FOREIGN PATENT DOCUMENTS

| | | | |
|---|---|---|---|
| EP | 0 116 443 | A1 | 8/1984 |
| EP | 0 606 981 | A1 | 7/1994 |

(Continued)

OTHER PUBLICATIONS

Canadian Office Action dated May 25, 2016, for Canadian Patent Application No. 2,848,409.

(Continued)

*Primary Examiner* — D. Andrews
(74) *Attorney, Agent, or Firm* — Patterson & Sheridan, L.L.P.

(57) ABSTRACT

A method for drilling a wellbore includes disposing a tubular string in the wellbore, wherein the tubular string includes a drill bit disposed at a bottom and a flow sub disposed on a top; injecting drilling fluid through a bore valve in the flow sub to rotate the drill bit; moving a sleeve in the flow sub to engage and close the bore valve; moving the sleeve independently from the bore valve to expose a flow port formed through a wall of the flow sub; and injecting the drilling fluid into the flow port while adding a stand to the top of the tubular string, wherein injection of drilling fluid into the tubular string is continuously maintained between drilling and adding the stand to the tubular string.

12 Claims, 13 Drawing Sheets

Related U.S. Application Data

(60) Provisional application No. 61/537,322, filed on Sep. 21, 2011.

(56) References Cited

U.S. PATENT DOCUMENTS

| | | | |
|---|---|---|---|
| 2,102,555 | A | 12/1937 | Dyer |
| 2,158,356 | A | 5/1939 | Dyer |
| 2,202,192 | A | 5/1940 | Cypher |
| 2,224,657 | A | 12/1940 | Rodgers |
| 2,239,586 | A | 4/1941 | Appleby |
| 2,858,838 | A | 11/1958 | Scaramucci |
| 3,036,590 | A | 5/1962 | Knox |
| 3,123,157 | A | 3/1964 | Graham |
| 3,268,017 | A | 8/1966 | Yarbrough |
| 3,298,385 | A | 1/1967 | Jackson et al. |
| 3,497,020 | A | 2/1970 | Kammerer, Jr. et al. |
| 3,559,739 | A | 2/1971 | Hutchison |
| 3,684,318 | A | 8/1972 | Eckert et al. |
| 4,310,050 | A | 1/1982 | Bourgoyne, Jr. |
| 4,315,553 | A | 2/1982 | Stallings |
| 4,393,940 | A | 7/1983 | Cooper et al. |
| 4,448,267 | A | 5/1984 | Crawford, III et al. |
| 4,478,244 | A | 10/1984 | Garrett |
| 4,566,478 | A | 1/1986 | Deaton |
| 4,566,494 | A | 1/1986 | Roche |
| 5,159,981 | A | 11/1992 | Le |
| 5,896,924 | A | 4/1999 | Carmody et al. |
| 6,119,772 | A | 9/2000 | Pruet |
| 6,230,824 | B1 | 5/2001 | Peterman et al. |
| 6,253,861 | B1 | 7/2001 | Carmichael et al. |
| 6,315,051 | B1 | 11/2001 | Ayling |
| 6,607,042 | B2 | 8/2003 | Hoyer et al. |
| 6,622,791 | B2 | 9/2003 | Kelley et al. |
| 6,739,397 | B2 | 5/2004 | Ayling |
| 7,028,586 | B2 | 4/2006 | Robichaux et al. |
| 7,108,080 | B2 | 9/2006 | Tessari et al. |
| 7,140,455 | B2 | 11/2006 | Walter et al. |
| 7,163,064 | B2 | 1/2007 | Moncus et al. |
| 7,219,722 | B2 | 5/2007 | Fincher et al. |
| 7,308,952 | B2 | 12/2007 | Strazhgorodskiy |
| 8,016,033 | B2 | 9/2011 | Iblings et al. |
| 9,353,587 | B2 * | 5/2016 | Bansal ..... E21B 21/10 |
| 2004/0003490 | A1 | 1/2004 | Shahin et al. |
| 2004/0020654 | A1 | 2/2004 | Milberger et al. |
| 2004/0154835 | A1 | 8/2004 | Allen et al. |
| 2006/0254822 | A1 | 11/2006 | Ayling |
| 2006/0278434 | A1 | 12/2006 | Calderoni et al. |
| 2009/0025930 | A1 | 1/2009 | Iblings et al. |
| 2009/0205838 | A1 | 8/2009 | Springett |
| 2009/0242817 | A1 | 10/2009 | Strazhgorodskiy |
| 2009/0272580 | A1 | 11/2009 | Dolman et al. |
| 2010/0084142 | A1 | 4/2010 | Calderoni et al. |
| 2010/0096190 | A1 | 4/2010 | Younger et al. |
| 2010/0155143 | A1 | 6/2010 | Braddick |
| 2010/0252272 | A1 | 10/2010 | Haughom |
| 2010/0300543 | A1 | 12/2010 | Braddick |
| 2011/0155379 | A1 | 6/2011 | Bailey et al. |

FOREIGN PATENT DOCUMENTS

| | | | |
|---|---|---|---|
| EP | 1 331 356 | A2 | 7/2003 |
| GB | 2 118 998 | A | 11/1983 |
| GB | 2 159 194 | A | 11/1985 |
| GB | 2 220 963 | A | 1/1990 |
| GB | 2 325 682 | A | 12/1998 |
| GB | 2 378 199 | A | 2/2003 |
| GB | 2 426 274 | A | 11/2006 |
| SU | 979616 | A1 | 12/1982 |
| WO | 2005/080745 | A1 | 9/2005 |
| WO | 2009/022914 | A1 | 2/2009 |
| WO | 2010/112933 | A2 | 10/2010 |

OTHER PUBLICATIONS

Managed Pressure Operations; Non Stop Driller Continuous Circulating System; date unknown, 2 total pages.

Inventors' Solutions Drilling—Production; "Continuous Flushing Drilling (CFD)"; date unknown, 13 total pages.

Vail et al.; New Developments in Air-Gas Drilling and Completions; Part 1; World Oil; Nov. 1963; 9 total pages.

Torsvoll, et al.; "Continuous Circulation During Drilling Utilizing a Drillstring Integrated Valve; The Continuous circulation Valve", SPE 98947, IADC/SPE Drilling Conference held in Miami, Florida, Feb. 21-23, 2006, 7 total pages.

Zreik, et al.; "Improving Surface Hole Foam Drilling Performance in Karstified Limestone in Papua New Guinea," 2010 ADC/SPE Asia Pac Drilling, Nov. 1-3, 2010, Ho Chi Minh City, Vietnam, 2 total pages.

PCT Notification of Transmittal of the International Search Report and The Written Opinion of the International Searching Authority for International Application PCT/US2012/056400; dated Feb. 14, 2014; 18 total pages.

Canadian Office Action for Application No. 2,848,409; dated Jul. 7, 2015; 4 total pages.

EPO Office Action dated Feb. 6, 2017 for European Patent Application No. 12778502.0.

Canadian Office Action dated Mar. 14, 2017, for Canadian Patent Application No. 2,848,409.

* cited by examiner

| Operation | Action | 38a | 38b | 38c | 38d | 238 | 36p | 36f |
|---|---|---|---|---|---|---|---|---|
| Drilling | Mud pumped via top drive | Open | Closed | Closed | Open | Closed | Auto | Auto |
| Install clamp | Operate band actuator | Open | Closed | Closed | Open | Closed | Auto | Auto |
| Test clamp seal | Monitor pressure | Open | Open | Closed | Closed | Open | Auto | Auto |
| Switch mud flow to clamp | Operate CFS actuator | Open | Open | Closed | Closed | Open | Auto | Auto |
| Bleed top drive | | Closed | Open | Open | Closed | Open | Auto | Auto |
| Test bore valve | Monitor pressure | Closed | Open | Closed | Closed | Open | Auto | Auto |
| Add stand to drill string | Operate top drive | Closed | Open | Open | Closed | Open | Auto | Auto |
| Pressurize added stand | | Open | Open | Closed | Closed | Open | Auto | Auto |
| Switch mud flow to top drive | Operate CFS actuator | Open | Open | Closed | Closed | Open | Auto | Auto |
| Bleed clamp | | Open | Closed | Closed | Open | Open | Auto | Auto |
| Test port valve | Monitor pressure | Open | Closed | Closed | Closed | Open | Auto | Auto |
| Remove clamp | Operate band actuator | Open | Closed | Closed | Open | Closed | Auto | Auto |
| Resume drilling | Mud pumped via top drive | Open | Closed | Closed | Open | Closed | Auto | Auto |
| Overpressure | | | | | | | Open | Auto |
| Overflow | | | | | | | Auto | Open |

FIG. 5B

| Operation | Action | 39a | 39b | 39c | 39d | 39e | 39f | 39g | 39h |
|---|---|---|---|---|---|---|---|---|---|
| Drilling | Mud pumped via top drive | Closed | Closed | Closed | Closed | Closed | Closed | Closed | Closed |
| Install clamp | Operate band actuator | Open | Closed | Closed | Open | Closed | Closed | Closed | Closed |
| Test clamp seal | Monitor pressure | Locked | Locked | Locked | Locked | Closed | Closed | Closed | Closed |
| Switch mud flow to clamp | Operate CFS actuator | Locked | Locked | Locked | Locked | Closed | Open | Closed | Open |
| Bleed top drive | | Locked | Locked | Locked | Locked | Locked | Locked | Locked | Locked |
| Test bore valve | Monitor pressure | Locked | Locked | Locked | Locked | Locked | Locked | Locked | Locked |
| Add stand to drill string | Operate top drive | Locked | Locked | Locked | Locked | Locked | Locked | Locked | Locked |
| Pressurize added stand | | Locked | Locked | Locked | Locked | Locked | Locked | Locked | Locked |
| Switch mud flow to top drive | Operate CFS actuator | Locked | Locked | Locked | Locked | Open | Closed | Open | Closed |
| Bleed clamp | | Locked | Locked | Locked | Locked | Closed | Closed | Closed | Closed |
| Test port valve | Monitor pressure | Locked | Locked | Locked | Locked | Closed | Closed | Closed | Closed |
| Remove clamp | Operate band actuator | Closed | Open | Open | Closed | Closed | Closed | Closed | Closed |
| Resume drilling | Mud pumped via top drive | Closed | Closed | Closed | Closed | Closed | Closed | Closed | Closed |

FIG. 5C

THREE-WAY FLOW SUB FOR CONTINUOUS CIRCULATION

BACKGROUND OF THE INVENTION

Field of the Invention

The present invention relates to a three way flow sub for continuous circulation.

Description of the Related Art

In many drilling operations to recover hydrocarbons, a drill string made by assembling joints of drill pipe with threaded connections and having a drill bit at the bottom is rotated to move the drill bit. Typically drilling fluid, such as oil or water based mud, is circulated to and through the drill bit to lubricate and cool the bit and to facilitate the removal of cuttings from the wellbore that is being formed. The drilling fluid and cuttings returns to the surface via an annulus formed between the drill string and the wellbore. At the surface, the cuttings are removed from the drilling fluid and the drilling fluid is recycled.

As the drill bit penetrates into the earth and the wellbore is lengthened, more joints of drill pipe are added to the drill string. This involves stopping the drilling while the joints are added. The process is reversed when the drill string is removed or tripped, e.g., to replace the drill bit or to perform other wellbore operations. Interruption of drilling may mean that the circulation of the mud stops and has to be re-started when drilling resumes. This can be time consuming, can cause deleterious effects on the walls of the wellbore being drilled, and can lead to formation damage and problems in maintaining an open wellbore. Also, a particular mud weight may be chosen to provide a static head relating to the ambient pressure at the top of a drill string when it is open while joints are being added or removed. The weighting of the mud can be very expensive.

To convey drilled cuttings away from a drill bit and up and out of a wellbore being drilled, the cuttings are maintained in suspension in the drilling fluid. If the flow of fluid with cuttings suspended in it ceases, the cuttings tend to fall within the fluid. This is inhibited by using relatively viscous drilling fluid; but thicker fluids require more power to pump. Further, restarting fluid circulation following a cessation of circulation may result in the overpressuring of a formation in which the wellbore is being formed.

SUMMARY OF THE INVENTION

The present invention relates to a three way flow sub for continuous circulation. In one embodiment, a flow sub for use with a drill string includes a tubular housing having a longitudinal bore formed therethrough and a flow port formed through a wall thereof; a bore valve operable between an open position and a closed position, wherein the bore valve allows free passage through the bore in the open position and isolates an upper portion of the bore from a lower portion of the bore in the closed position; and a sleeve disposed in the housing and movable between an open position where the flow port is exposed to the bore and a closed position where a wall of the sleeve is disposed between the flow port and the bore; and a bore valve actuator operably coupling the sleeve and the bore valve such that opening the sleeve closes the bore valve and closing the sleeve opens the bore valve.

In another embodiment, a method for drilling a wellbore includes: drilling the wellbore by injecting drilling fluid into a top of a tubular string disposed in the wellbore at a first flow rate and rotating a drill bit. The tubular string includes: the drill bit disposed at a bottom thereof, tubular joints connected together, each joint having a longitudinal bore formed therethrough and at least one of the joints having a port formed through a wall thereof, a port valve in a closed position isolating the bore from the port, and a bore valve in an open position and operably coupled to the port valve. The drilling fluid exits the drill bit and carries cuttings from the drill bit. The cuttings and drilling fluid (returns) flow from the drill bit via an annulus defined between the tubular string and the wellbore. The method further includes: opening the port valve, thereby also automatically closing the bore valve which isolates the top of the tubular string from the port; and injecting the drilling fluid into the port at a second flow rate while adding a stand to the tubular string. Injection of drilling fluid into the tubular string is continuously maintained between drilling and adding the stand to the tubular string.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIGS. 5B and 5C illustrate operation of the drilling system.

DETAILED DESCRIPTION

Figure 1A:
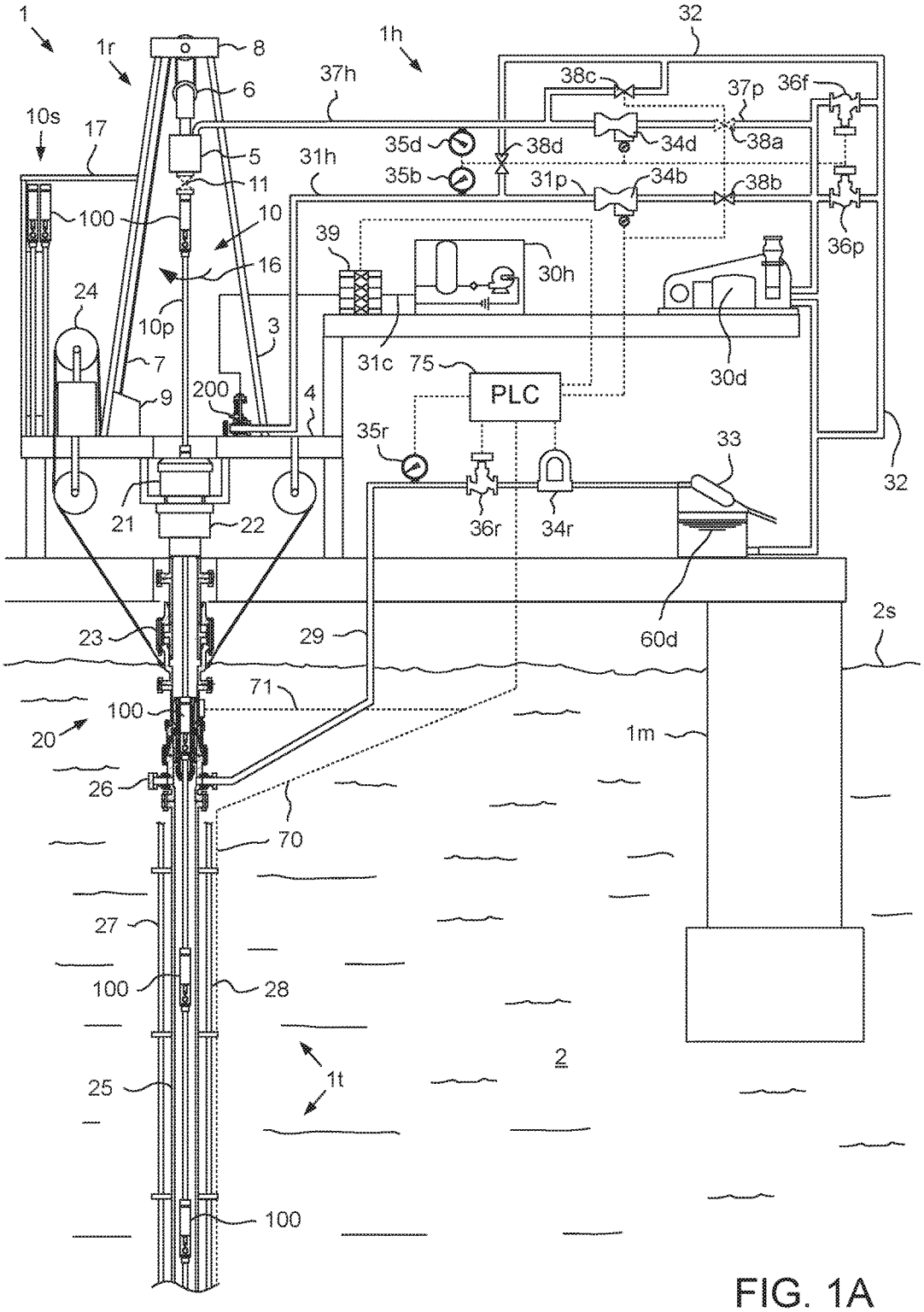
FIGS. 1A-1C illustrate a drilling system in a drilling mode, according to one embodiment of the present invention.
Figure 1B:
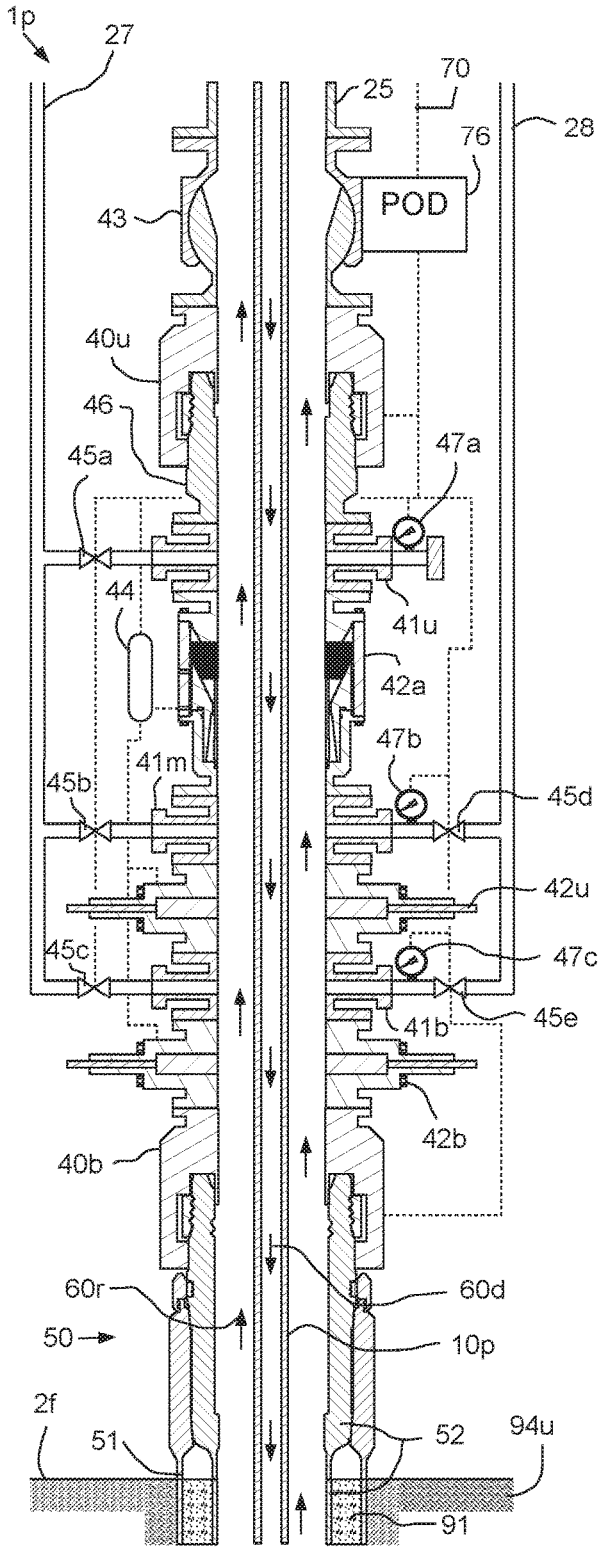
Figure 1C:
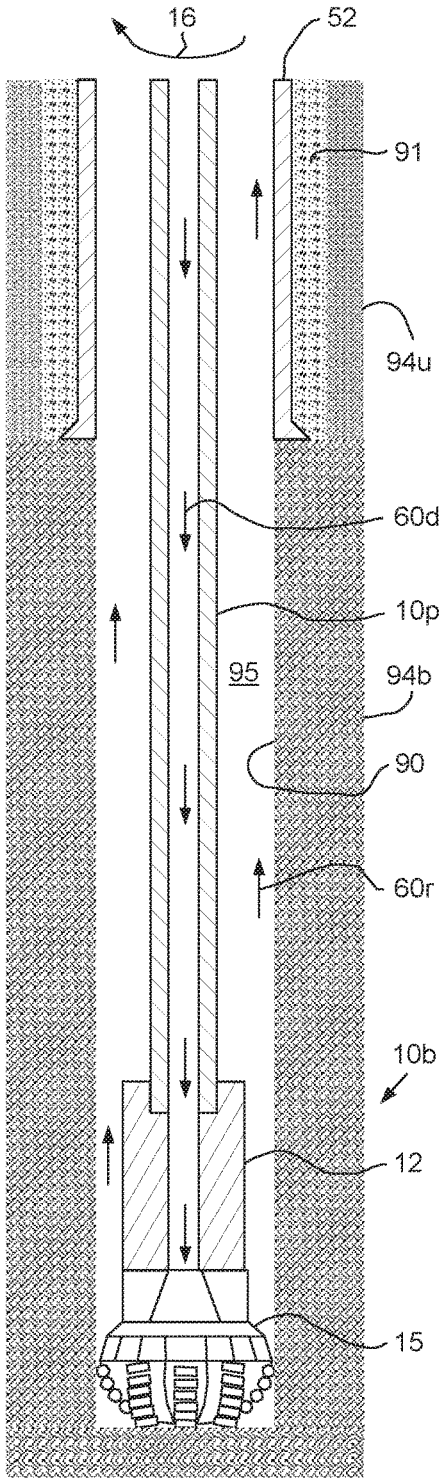

FIGS. 1A-1C illustrate a drilling system 1 in a drilling mode, according to one embodiment of the present invention. The drilling system 1 may include a mobile offshore drilling unit (MODU) 1*m*, such as a semi-submersible, a drilling rig 1*r*, a fluid handling system 1*h*, a fluid transport system 1*t*, and a pressure control assembly (PCA) 1*p*. The MODU 1*m* may carry the drilling rig 1*r* and the fluid handling system 1*h* aboard and may include a moon pool, through which drilling operations are conducted. The semi-submersible MODU 1*m* may include a lower barge hull which floats below a surface (aka waterline) 2*s* of sea 2 and is, therefore, less subject to surface wave action. Stability columns (only one shown) may be mounted on the lower barge hull for supporting an upper hull above the waterline. The upper hull may have one or more decks for carrying the drilling rig 1*r* and fluid handling system 1*h*. The MODU 1*m* may further have a dynamic positioning system (DPS) (not shown) or be moored for maintaining the moon pool in position over a subsea wellhead 50.

Alternatively, a fixed offshore drilling unit or a non-mobile floating offshore drilling unit may be used instead of the MODU 1*m*. Alternatively, the wellbore may be subsea having a wellhead located adjacent to the waterline and the drilling rig may be a located on a platform adjacent the wellhead. Alternatively, the drilling system may be used for drilling a subterranean (aka land based) wellbore and the MODU 1*m* may be omitted.

The drilling rig 1*r* may include a derrick 3 having a rig floor 4 at its lower end having an opening corresponding to the moonpool. The drilling rig 1*r* may further include a top drive 5. The top drive 5 may include a motor for rotating 16 a drill string 10. The top drive motor may be electric or hydraulic. A housing of the top drive 5 may be coupled to a rail (not shown) of the derrick 3 for preventing rotation of the top drive housing during rotation of the drill string 10 and allowing for vertical movement of the top drive with a traveling block 6. A housing of the top drive 5 may be suspended from the derrick 3 by the traveling block 6. The traveling block 6 may be supported by wire rope 7 connected at its upper end to a crown block 8. The wire rope 7 may be woven through sheaves of the blocks 6, 8 and extend to drawworks 9 for reeling thereof, thereby raising or lowering the traveling block 6 relative to the derrick 3. A Kelly valve 11 may be connected to a quill of a top drive 5. A top of the drill string 10 may be connected to the Kelly valve 11, such as by a threaded connection or by a gripper (not shown), such as a torque head or spear. The drilling rig 1*r* may further include a drill string compensator (not shown) to account for heave of the MODU 1*m*. The drill string compensator may be disposed between the traveling block 6 and the top drive 5 (aka hook mounted) or between the crown block 8 and the derrick 3 (aka top mounted).

The fluid transport system it may include the drill string 10, an upper marine riser package (UMRP) 20, a marine riser 25, a booster line 27, and a choke line 28. The drill string 10 may include a bottomhole assembly (BHA) 10*b*, joints of drill pipe 10*p* connected together, such as by threaded couplings (FIG. 5A), and one or more (four shown) flow subs 100. The BHA 10*b* may be connected to the drill pipe 10*p*, such as by a threaded connection, and include a drill bit 15 and one or more drill collars 12 connected thereto, such as by a threaded connection. The drill bit 15 may be rotated 16 by the top drive 5 via the drill pipe 10*p* and/or the BHA 10*b* may further include a drilling motor (not shown) for rotating the drill bit. The BHA 10*b* may further include an instrumentation sub (not shown), such as a measurement while drilling (MWD) and/or a logging while drilling (LWD) sub.

The PCA 1*p* may be connected to a wellhead 50 adjacently located to a floor 2*f* of the sea 2. A conductor string 51 may be driven into the seafloor 2*f*. The conductor string 51 may include a housing and joints of conductor pipe connected together, such as by threaded connections. Once the conductor string 51 has been set, a subsea wellbore 90 may be drilled into the seafloor 2*f* and a first casing string 52 may be deployed into the wellbore. The first casing string 52 may include a wellhead housing and joints of casing connected together, such as by threaded connections. The wellhead housing may land in the conductor housing during deployment of the first casing string 52. The first casing string 52 may be cemented 91 into the wellbore 90. The first casing string 52 may extend to a depth adjacent a bottom of an upper formation 94*u*. The upper formation 94*u* may be non-productive and a lower formation 94*b* may be a hydrocarbon-bearing reservoir. Alternatively, the lower formation 94*b* may be environmentally sensitive, such as an aquifer, or unstable. Although shown as vertical, the wellbore 90 may include a vertical portion and a deviated, such as horizontal, portion.

The PCA 1*p* may include a wellhead adapter 40*b*, one or more flow crosses 41*u,m,b*, one or more blow out preventers (BOPs) 42*a,u,b*, a lower marine riser package (LMRP), one or more accumulators 44, and a receiver 46. The LMRP may include a control pod 76, a flex joint 43, and a connector 40*u*. The wellhead adapter 40*b*, flow crosses 41*u,m,b*, BOPs 42*a,u,b*, receiver 46, connector 40*u*, and flex joint 43, may each include a housing having a longitudinal bore therethrough and may each be connected, such as by flanges, such that a continuous bore is maintained therethrough. The bore may have drift diameter, corresponding to a drift diameter of the wellhead 50.

Each of the connector 40*u* and wellhead adapter 40*b* may include one or more fasteners, such as dogs, for fastening the LMRP to the BOPs 42*a,u,b* and the PCA 1*p* to an external profile of the wellhead housing, respectively. Each of the connector 40*u* and wellhead adapter 40*b* may further include a seal sleeve for engaging an internal profile of the respective receiver 46 and wellhead housing. Each of the connector 40*u* and wellhead adapter 40*b* may be in electric or hydraulic communication with the control pod 76 and/or further include an electric or hydraulic actuator and an interface, such as a hot stab, so that a remotely operated subsea vehicle (ROV) (not shown) may operate the actuator for engaging the dogs with the external profile.

The LMRP may receive a lower end of the riser 25 and connect the riser to the PCA 1*p*. The control pod 76 may be in electric, hydraulic, and/or optical communication with a programmable logic controller (PLC) 75 onboard the MODU 1*m* via an umbilical 70. The control pod 76 may include one or more control valves (not shown) in communication with the BOPs 42*a,u,b* for operation thereof. Each control valve may include an electric or hydraulic actuator in communication with the umbilical 70. The umbilical 70 may include one or more hydraulic or electric control conduit/cables for the actuators. The accumulators 44 may store pressurized hydraulic fluid for operating the BOPs 42*a,u,b*. Additionally, the accumulators 44 may be used for operating one or more of the other components of the PCA 1*p*. The umbilical 70 may further include hydraulic, electric, and/or optic control conduit/cables for operating various functions of the PCA 1*p*. The PLC 75 may operate the PCA 1*p* via the umbilical 70 and the control pod 76.

A lower end of the booster line 27 may be connected to a branch of the flow cross 41*u* by a shutoff valve 45*a*. A booster manifold may also connect to the booster line lower end and have a prong connected to a respective branch of each flow cross 41*m,b*. Shutoff valves 45*b,c* may be disposed in respective prongs of the booster manifold. Alternatively, a separate kill line (not shown) may be connected to the branches of the flow crosses 41*m,b* instead of the booster manifold. An upper end of the booster line 27 may be connected to an outlet of a booster pump (not shown). A lower end of the choke line 28 may have prongs connected to respective second branches of the flow crosses 41*m,b*. Shutoff valves 45*d,e* may be disposed in respective prongs of the choke line lower end.

A pressure sensor 47*a* may be connected to a second branch of the upper flow cross 41*u*. Pressure sensors 47*b,c* may be connected to the choke line prongs between respective shutoff valves 45*d,e* and respective flow cross second branches. Each pressure sensor 47*a-c* may be in data communication with the control pod 76. The lines 27, 28 and umbilical 70 may extend between the MODU 1*m* and the PCA 1*p* by being fastened to brackets disposed along the riser 25. Each line 27, 28 may be a flow conduit, such as coiled tubing. Each shutoff valve 45*a-e* may be automated and have a hydraulic actuator (not shown) operable by the control pod 76 via fluid communication with a respective umbilical conduit or the LMRP accumulators 44. Alternatively, the valve actuators may be electrical or pneumatic.

The riser 25 may extend from the PCA 1*p* to the MODU 1*m* and may connect to the MODU via the UMRP 20. The UMRP 20 may include a diverter 21, a flex joint 22, a slip (aka telescopic) joint 23, a tensioner 24, and a rotating control device (RCD) 26. A lower end of the RCD 26 may be connected to an upper end of the riser 25, such as by a flanged connection. The slip joint 23 may include an outer barrel connected to an upper end of the RCD 26, such as by a flanged connection, and an inner barrel connected to the flex joint 22, such as by a flanged connection. The outer barrel may also be connected to the tensioner 24, such as by a tensioner ring (not shown).

The flex joint 22 may also connect to the diverter 21, such as by a flanged connection. The diverter 21 may also be connected to the rig floor 4, such as by a bracket. The slip joint 23 may be operable to extend and retract in response to heave of the MODU 1*m* relative to the riser 25 while the tensioner 24 may reel wire rope in response to the heave, thereby supporting the riser 25 from the MODU 1*m* while accommodating the heave. The flex joints 23, 43 may accommodate respective horizontal and/or rotational (aka pitch and roll) movement of the MODU 1*m* relative to the riser 25 and the riser relative to the PCA 1*p*. The riser 25 may have one or more buoyancy modules (not shown) disposed therealong to reduce load on the tensioner 24.

The RCD 26 (see also FIG. 7B) may include a housing, a piston, a latch, and a rider. The housing may be tubular and have one or more sections connected together, such as by flanged connections. The rider may include a bearing assembly, one or more stripper seals, and a catch, such as a sleeve. The rider may be selectively longitudinally and torsionally connected to the housing by engagement of the latch with the catch sleeve. The housing may have hydraulic ports in fluid communication with the piston and an interface of the RCD. The bearing assembly may be connected to the stripper seals. The bearing assembly may allow the stripper seals to rotate relative to the housing. The bearing assembly may include one or more radial bearings, one or more thrust bearings, and a self contained lubricant system.

Each stripper seal may be directional and oriented to seal against the drill pipe 10*p* in response to higher pressure in the riser 25 than the UMRP 20 (components thereof above the RCD). In operation, the drill pipe 10*p* may be received through the rider so that the stripper seals may engage the drill pipe in response to sufficient pressure differential. Each stripper seal may also be flexible enough to seal against an outer surface of the drill pipe 10*p* having a pipe diameter and an outer surface of threaded couplings of the drill pipe having a larger tool joint diameter. The RCD 26 may provide a desired barrier in the riser 25 either when the drill pipe is stationary or rotating. Alternatively, an active seal RCD may be used. The RCD housing may be submerged adjacent the waterline 2*s*. The RCD interface may be in fluid communication with an auxiliary hydraulic power unit (HPU) (not shown) of the PLC 75 via an auxiliary umbilical 71.

Alternatively, the rider may be non-releasably connected to the housing. Alternatively, the RCD may be located above the waterline and/or along the UMRP at any other location besides a lower end thereof. Alternatively, the RCD may be located at an upper end of the UMRP and the slip joint 23 and bracket connecting the UMRP to the rig may be omitted or the slip joint may be locked instead of being omitted. Alternatively, the RCD may be assembled as part of the riser at any location therealong.

The fluid handling system 1*h* may include a return line 29, mud pump 30*d*, one or more hydraulic power units (HPUs) 30*h* (one shown in FIG. 1A and two shown in FIG. 5A), a bypass line 31*p,h*, one or more hydraulic lines 31*c*, a drain line 32, a solids separator, such as a shale shaker 33, one or more flow meters 34*b,d,r*, one or more pressure sensors 35*b,d,r*, one or more variable choke valves, such as chokes 36*f,p,r*, a supply line 37*p,h*, one or more shutoff valves 38*a-d*, a hydraulic manifold 39, and a clamp 200.

Figure 3A:
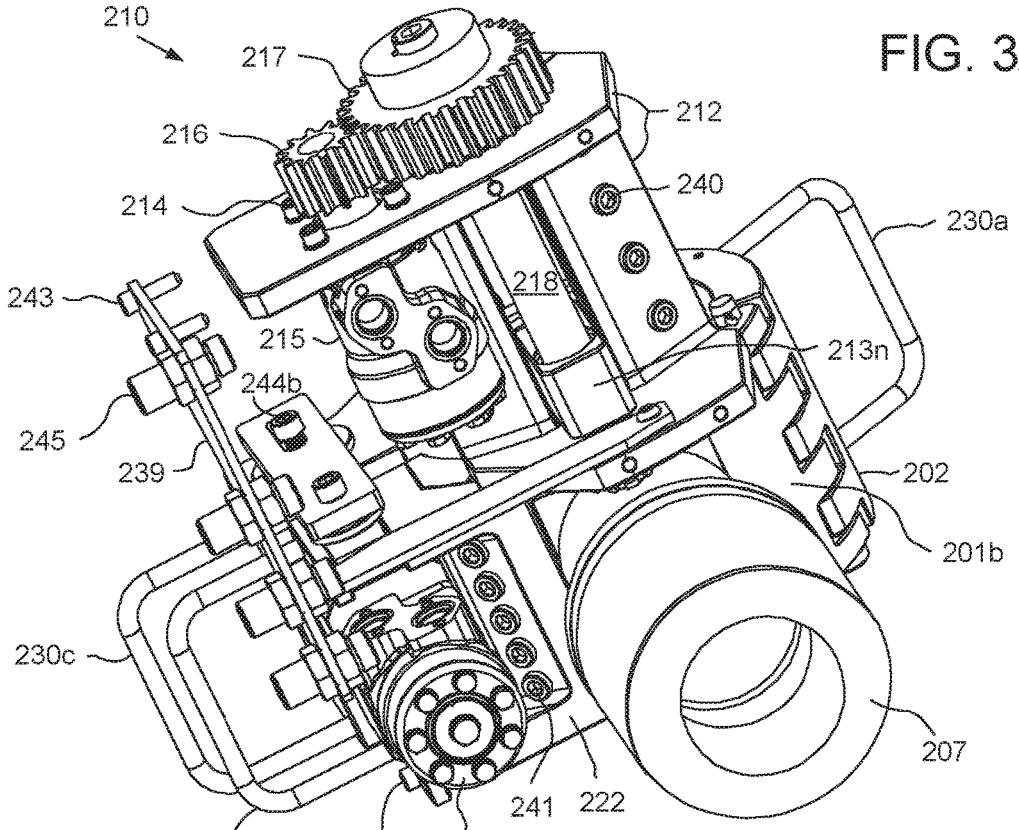
FIGS. 3A-3D illustrate a clamp of the drilling system.
Figure 3B:
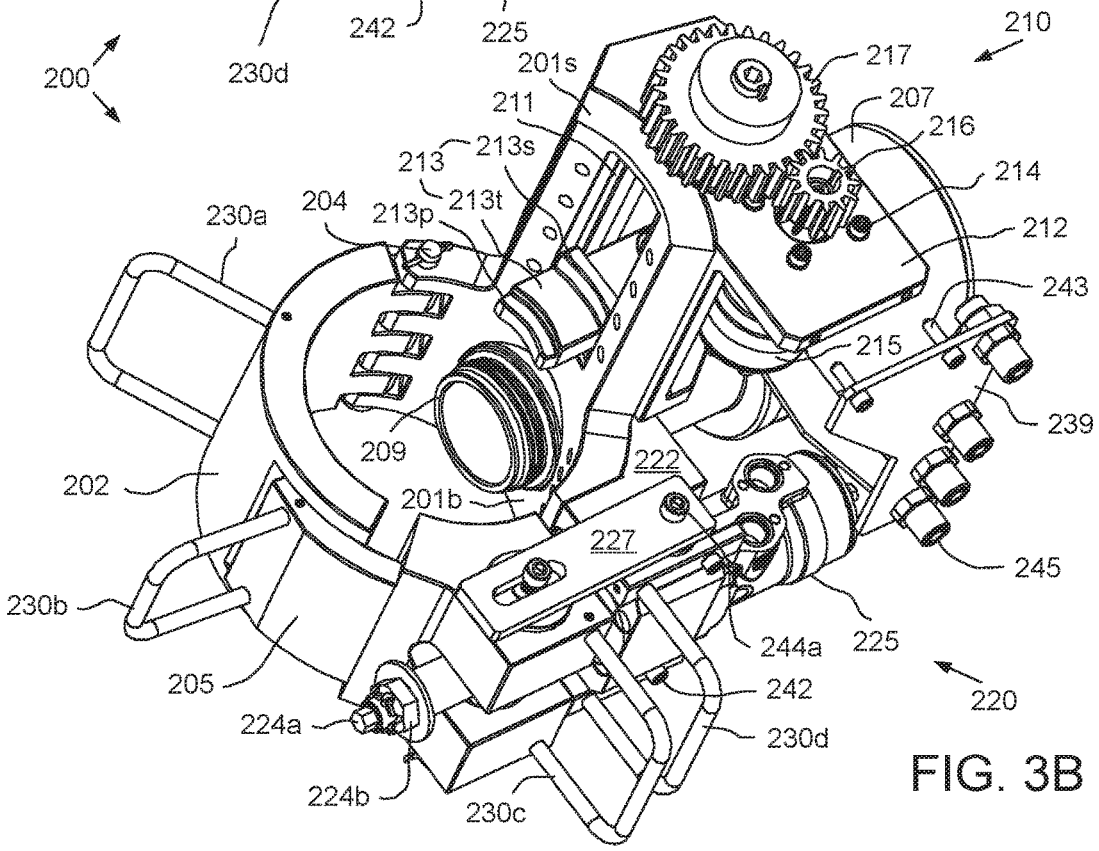
Figures 3C, 3D:
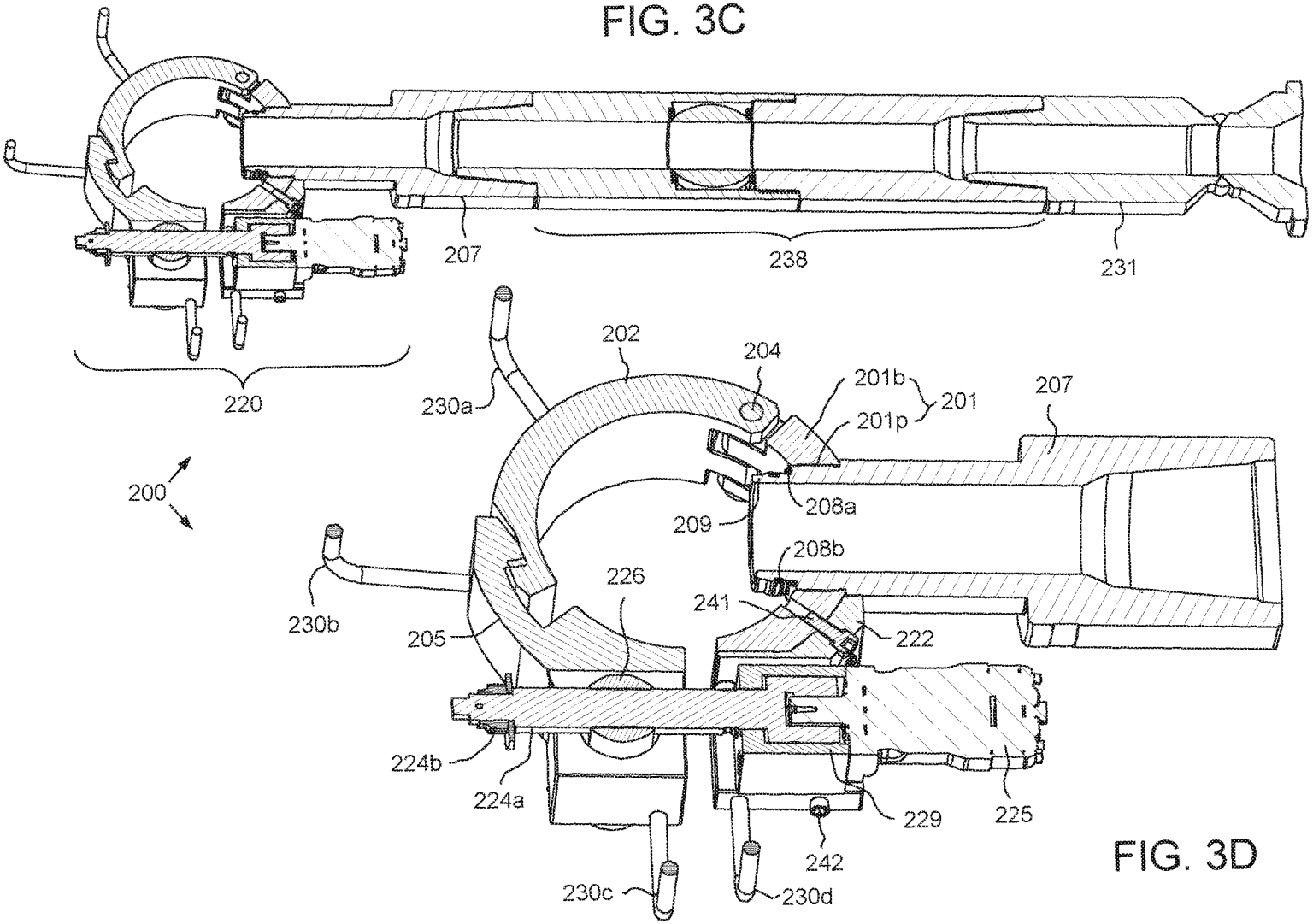

A lower end of the return line 29 may be connected to an outlet of the RCD 26 and an upper end of the return line may be connected to an inlet of the mud pump 30*d*. The returns pressure sensor 35*r*, returns choke 36*r*, returns flow meter 34*r*, and shale shaker 33 may be assembled as part of the return line 29. A lower end of the supply line 37*p,h* may be connected to an outlet of the mud pump 30*d* and an upper end of the supply line may be connected to an inlet of the top drive 5. The supply pressure sensor 35*d*, supply flow meter 34*d*, and supply shutoff valve 38*a* may be assembled as part of the supply line 37*p,h*. A first end of the bypass line 31*p,h* may be connected to an outlet of the mud pump 30*d* and a second end of the bypass line may be connected to an inlet 207 (FIG. 3A) of the clamp 200. The bypass pressure sensor 35*b*, bypass flow meter 34*b*, and bypass shutoff valve 38*b* may be assembled as part of the bypass line 31*p,h*.

A first end of the drain line 32 may be connected to the return line 29 and a second portion of the drain line may have prongs (four shown). A first drain prong may be connected to the bypass line 31*p,h*. A second drain prong may be connected to the supply line 37*p,h*. Third and fourth drain prongs may be connected to an outlet of the mud pump 30*d*. The supply drain valve 38*c*, bypass drain valve 38*d*, pressure choke 36*p*, and flow choke 36*f* may be assembled as part of the drain line 32. A first end of the hydraulic lines 31*c* may be connected to the HPU 30*h* and a second end of the hydraulic lines may be connected to the clamp 200. The hydraulic manifold 39 may be assembled as part of the hydraulic lines 31*c*.

Each choke 36*f,p,r* may include a hydraulic actuator operated by the PLC 75 via the auxiliary HPU (not shown). The returns choke 36*r* may be operated by the PLC to maintain backpressure in the riser 25. The flow choke 36*f* may be operated (FIG. 5B) by the PLC 75 to prevent a flow rate supplied to the flow sub 100 and clamp 200 in bypass mode (FIG. 5A) from exceeding a maximum allowable flow rate of the flow sub and/or clamp. Alternatively, the choke actuators may be electrical or pneumatic. The pressure choke 36*p* may be operated by the PLC 75 to protect against overpressure of the clamp 200 by the mud pump 30*d*. Each shutoff valve 38*a-d* may be automated and have a hydraulic actuator (not shown) operable by the PLC 75 via the auxiliary HPU. Alternatively, the valve actuators may be electrical or pneumatic.

Each pressure sensor 35*b,d,r* may be in data communication with the PLC 75. The returns pressure sensor 35*r* may be operable to measure backpressure exerted by the returns choke 36. The supply pressure sensor 35*d* may be operable to measure standpipe pressure. The bypass pressure sensor 35*b* may be operable to measure pressure of the clamp inlet 207. The returns flow meter 34*r* may be a mass flow meter, such as a Coriolis flow meter, and may be in data communication with the PLC 75. The returns flow meter 34*r* may be connected in the return line 29 downstream of the returns choke 36*r* and may be operable to measure a flow rate of the returns 60*r*. Each of the supply 34*d* and bypass 34*b* flow meters may be a volumetric flow meter, such as a Venturi flow meter. The supply flow meter 34*d* may be operable to measure a flow rate of drilling fluid supplied by the mud pump 30*d* to the drill string 10 via the top drive 5. The bypass flow meter 34*b* may be operable to measure a flow rate of drilling fluid supplied by the mud pump 30*d* to the clamp inlet 207. The PLC 75 may receive a density measurement of the drilling fluid 60*d* from a mud blender (not shown) to determine a mass flow rate of the drilling fluid. Alternatively, the bypass 34*b* and supply 34*d* flow meters may each be mass flow meters.

In the drilling mode, the mud pump 30*d* may pump drilling fluid 60*d* from the shaker 33 (or fluid tank connected thereto), through the pump outlet, standpipe 37*p* and Kelly hose 37*h* to the top drive 5. The drilling fluid 60*d* may include a base liquid. The base liquid may be base oil, water, brine, or a water/oil emulsion. The base oil may be diesel, kerosene, naphtha, mineral oil, or synthetic oil. The drilling fluid 60*d* may further include solids dissolved or suspended in the base liquid, such as organophilic clay, lignite, and/or asphalt, thereby forming a mud.

The drilling fluid 60*d* may flow from the Kelly hose 37*h* and into the drill string 10 via the top drive 5 and Kelly valve 11. The drilling fluid 60*d* may flow down through the drill string 10 and exit the drill bit 15, where the fluid may circulate the cuttings away from the bit and return the cuttings up an annulus 95 formed between an inner surface of the casing 91 or wellbore 90 and an outer surface of the drill string 10. The returns 60*r* (drilling fluid 60*d* plus cuttings) may flow through the annulus 95 to the wellhead 50. The returns 60*r* may continue from the wellhead 50 and into the riser 25 via the PCA 1*p*. The returns 60*r* may flow up the riser 25 to the RCD 26. The returns 60*r* may be diverted by the RCD 26 into the return line 29 via the RCD outlet. The returns 60*r* may continue through the returns choke 36*r* and the flow meter 34*r*. The returns 60*r* may then flow into the shale shaker 33 and be processed thereby to remove the cuttings, thereby completing a cycle. As the drilling fluid 60*d* and returns 60*r* circulate, the drill string 10 may be rotated 16 by the top drive 5 and lowered by the traveling block 6, thereby extending the wellbore 90 into the lower formation 94*b*.

The PLC 75 may be programmed to operate the returns choke 36*r* so that a target bottomhole pressure (BHP) is maintained in the annulus 95 during the drilling operation. The target BHP may be selected to be within a drilling window defined as greater than or equal to a minimum threshold pressure, such as pore pressure, of the lower formation 94*b* and less than or equal to a maximum threshold pressure, such as fracture pressure, of the lower formation, such as an average of the pore and fracture BHPs. Alternatively, the minimum threshold may be stability pressure and/or the maximum threshold may be leakoff pressure. Alternatively, threshold pressure gradients may be used instead of pressures and the gradients may be at other depths along the lower formation 94*b* besides bottomhole, such as the depth of the maximum pore gradient and the depth of the minimum fracture gradient. Alternatively, the PLC 75 may be free to vary the BHP within the window during the drilling operation.

A static density of the drilling fluid 60*d* (typically assumed equal to returns 60*r*; effect of cuttings typically assumed to be negligible) may correspond to a threshold pressure gradient of the lower formation 94*b*, such as being equal to a pore pressure gradient. Alternatively, a static density of the drilling fluid 60*d* may be slightly less than the pore pressure gradient such that an equivalent circulation density (ECD) (static density plus dynamic friction drag) during drilling is equal to the pore pressure gradient. Alternatively, a static density of the drilling fluid 60*d* may be slightly greater than the pore pressure gradient. During the drilling operation, the PLC 75 may execute a real time simulation of the drilling operation in order to predict the actual BHP from measured data, such as standpipe pressure from sensor 35*d*, mud pump flow rate from the supply flow meter 34*d*, wellhead pressure from an of the sensors 47*a-c*, and return fluid flow rate from the return flow meter 34*r*. The PLC 75 may then compare the predicted BHP to the target BHP and adjust the returns choke 36*r* accordingly.

During the drilling operation, the PLC 75 may also perform a mass balance to monitor for a kick (not shown) or lost circulation (not shown). As the drilling fluid 60*d* is being pumped into the wellbore 90 by the mud pump 30*d* and the returns 60*r* are being received from the return line 29, the PLC 75 may compare the mass flow rates (i.e., drilling fluid flow rate minus returns flow rate) using the respective flow meters 34*d,r*. The PLC 75 may use the mass balance to monitor for formation fluid (not shown) entering the annulus 95 and contaminating the returns 60*r* or returns 60*r* entering the formation 94*b*.

Upon detection of either event, the PLC 75 may take remedial action, such as diverting the flow of returns 60*r* from an outlet of the returns flow meter to a degassing spool (not shown). The degassing spool may include automated shutoff valves at each end, a mud-gas separator (MGS), and a gas detector. A first end of the degassing spool may be connected to the returns line 29 between the returns flow meter and the shaker 33 and a second end of the degasser spool may be connected to an inlet of the shaker. The gas detector may include a probe having a membrane for sampling gas from the returns 60*r*, a gas chromatograph, and a carrier system for delivering the gas sample to the chromatograph. The MGS may include an inlet and a liquid outlet assembled as part of the degassing spool and a gas outlet connected to a flare or a gas storage vessel. The PLC 75 may also adjust the returns choke 36*r* accordingly, such as tightening the choke in response to a kick and loosening the choke in response to loss of the returns.

Alternatively, the PLC 75 may estimate a mass rate of cuttings (and add the cuttings mass rate to the intake sum) using a rate of penetration (ROP) of the drill bit or a mass flow meter may be added to the cuttings chute of the shaker and the PLC may directly measure the cuttings mass rate.

Figures 2A, 2B, 2C:
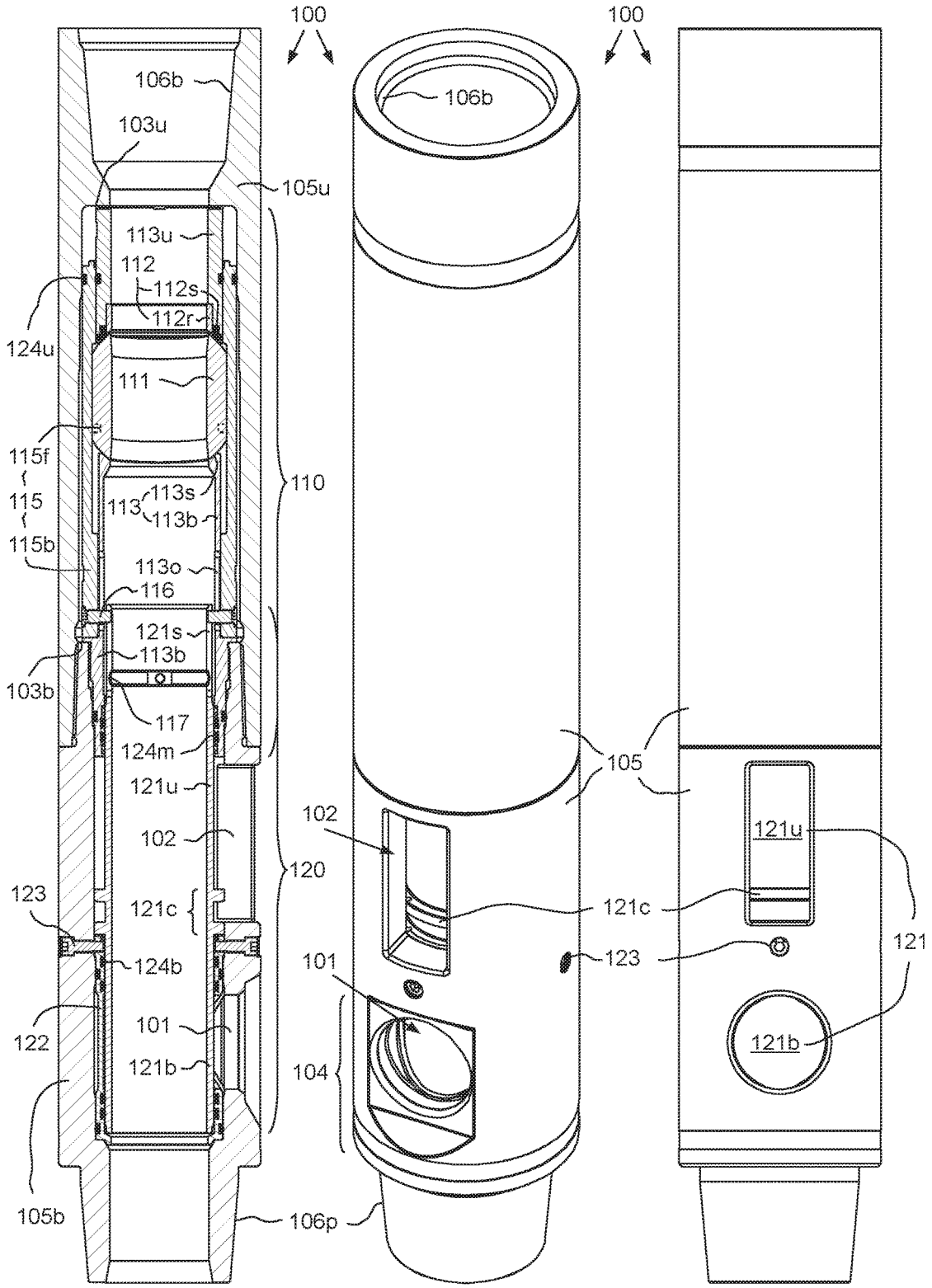
FIGS. 2A-2C illustrate a flow sub of the drilling system in a top injection mode.

FIGS. 2A-2C illustrate the flow sub 100 in a top injection mode. The flow sub 100 may include a tubular housing 105, a bore valve 110, a bore valve actuator, and a side port valve 120. The housing 105 may include one or more sections, such as an upper section 105*u* and a lower 105*b* section, each section connected together, such as by a threaded connection. An outer diameter of the housing may correspond to the tool joint diameter of the drill pipe 10*p* to maintain compatibility with the RCD 26. The housing 105 may have a central longitudinal bore formed therethrough and a radial flow port 101 formed through a wall thereof in fluid communication with the bore (in this mode) and located at a side of the lower housing section 105*b*. Alternatively, the side port 101 may be inclined between the radial and longitudinal axes of the housing 105. The housing 105 may also have a threaded coupling at each longitudinal end, such as box 106*b* formed in an upper longitudinal end and a pin 106*p* formed on a lower longitudinal end, so that the housing may be assembled as part of the drill string 10. Except for seals and where otherwise specified, the flow sub 100 may be made from a metal or alloy, such as steel, stainless steel, or a nickel based alloy. Seals may be made from a polymer, such as a thermoplastic, elastomer, or copolymer and may or may not be housed in a gland.

A length of the housing 105 may be equal to or less than the length of a standard joint of drill pipe 10*p*. Additionally, the housing 105 may be provided with one or more pup joints (not shown) in order to provide for a total assembly length equivalent to that of a standard joint of drill pipe 10*p*. The pup joints may include one or more centralizers (not shown) (aka stabilizers) or the centralizers may be mounted on the housing 105. The centralizers may be of rigid construction or of yielding, flexible, or sprung construction. The centralizers may be constructed from any suitable material or combination of materials, such as metal or alloy, or a polymer, such as an elastomer, such as rubber. The centralizers may be molded or mounted in such a way that rotation of the housing/pup joint about its longitudinal axis also rotates the stabilizers or centralizers. Alternatively, the centralizers may be mounted such that at least a portion of the centralizers may be able to rotate independently of the housing/pup point.

The bore valve 110 may include a closure member, such as a ball 111, a seat 112, and a body, such as a cage 113. The cage 113 may include one or more sections, such as an upper section 113*u* and a lower 113*b* section. The lower cage section 113*b* may be disposed within the housing 105 and connected thereto, such as by a threaded connection and engagement with a lower shoulder 103*b* of the housing 105. The upper cage section 113*u* may be disposed within the housing 105 and connected thereto, such as by entrapment between the ball 111 and an upper shoulder 103*u* of the housing. The upper shoulder 103*u* may be formed in an inner surface of the upper housing section 105*u* and the lower shoulder 103*b* may be a top of the lower housing section 105*b*. The seat 112 may include a seal 112*s* and a retainer 112*r*. The seat retainer 112*r* may be connected to the upper cage section 113*u*, such as by a threaded connection. The seat seal 112*s* may be connected to the upper cage section 113*u*, such as by a lip and groove connection and by being disposed between the upper cage section and the seat retainer 112*r*. A top of the lower cage section 113*b* may serve as a stopper 113*s* for the ball 111. Alternatively, a lower seat may be used instead of the stopper 113*s*.

The ball 111 may be disposed between the cage sections 113*u,b* and may be rotatable relative thereto. The ball 111 may be operable between an open position (FIGS. 2A, 4A, 4B, 4E, and 4F) and a closed position (FIGS. 4C, 4D, and 5A) by the bore valve actuator. The ball 111 may have a bore formed therethrough corresponding to the housing bore and aligned therewith in the open position. A wall of the ball 111 may close an upper portion of the housing bore in the closed position and the ball 111 may engage the seat seal 112*s* in response to pressure exerted against the ball by fluid injection into the side port 101.

The port valve 120 may include a closure member, such as a sleeve 121, and a seal mandrel 122. The seal mandrel 122 may be made from an erosion resistant material, such as tool steel, ceramic, or cermet. The seal mandrel 122 may be disposed within the housing 105 and connected thereto, such as by one or more (two shown) fasteners 123. The seal mandrel 122 may have a port formed through a wall thereof corresponding to and aligned with the side port 101. Lower seals 124*b* may be disposed between the housing 105 and the seal mandrel 122 and between the seal mandrel and the sleeve 121 to isolate the interfaces thereof. The port valve 120 may have a maximum allowable flow rate greater than, equal to, or slightly less than a flow rate of the drilling fluid 60*d* in drilling mode.

The sleeve 121 may be disposed within the housing 105 and longitudinally moveable relative thereto between an open position (FIG. 4D) and a closed position (FIGS. 2A-2C, 4A, and 4F) by the clamp 200. In the open position, the side port 101 may be in fluid communication with a lower portion of the housing bore. In the closed position, the sleeve 121 may isolate the side port 101 from the housing bore by engagement with the lower seals 124*b* of the seal sleeve 122. The sleeve may include an upper portion 121*u*, a lower portion 121*b*, and a lug 121*c* disposed between the upper and lower portions.

A window 102 may be formed through a wall of the lower housing section 105*b* and may extend a length corresponding to a stroke of the port valve 120. The window 102 may be aligned with the side port 101. The lug 121*c* may be accessible through the window 102. A recess 104 may be formed in an outer surface of the lower housing section 105*b* adjacent to the side port 101 for receiving a stab connector 209 formed at an end of an inlet 207 of the clamp 200. Mid seals 124*m* may be disposed between the housing 105 and the lower cage section 113*b* and between the lower cage section and the sleeve 121 to isolate the interfaces thereof.

The bore valve actuator may be mechanical and include a cam 115, a linkage, such as one or more (two shown) pins 116 and slots 121*s*, and a toggle, such as a split ring 117. An upper annulus may be formed between the cage 113 and the upper housing section 105*u* and a lower annulus may be formed between the valve sleeve 121 and the lower housing section 105*b*. The cam 115 may be disposed in the upper annulus and may be longitudinally movable relative to the housing 105. The cam 115 may interact with the ball 111, such as by having one or more (two shown) followers 115*f*, each formed in an inner surface of a body 115*b* thereof and extending into a respective cam profile (not shown) formed in an outer surface of the ball 111 or vice versa. Alternatively, each follower 115*f* may be a separate member fastened to the cam body 115*b*. The ball-cam interaction may rotate the ball 111 between the open and closed positions in response to longitudinal movement of the cam 115 relative to the ball.

Figure 4A:
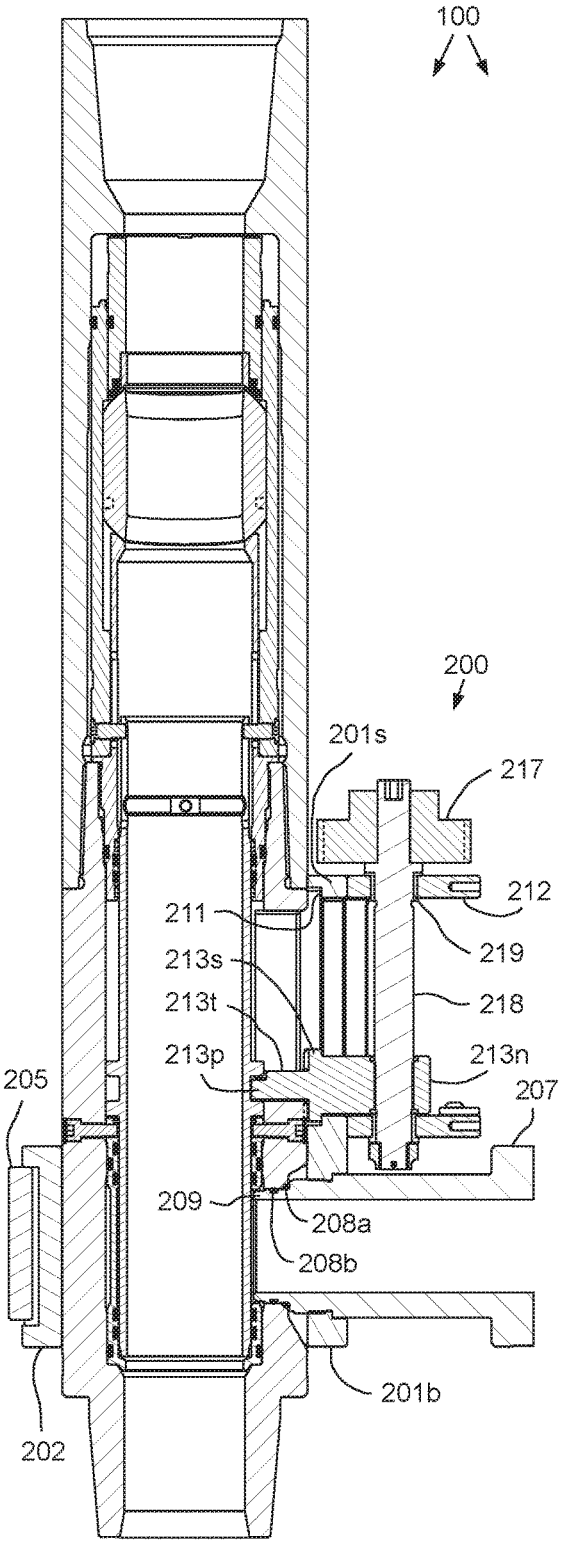
FIGS. 4A-4F illustrate operation of the flow sub and the clamp.
Figure 4B:
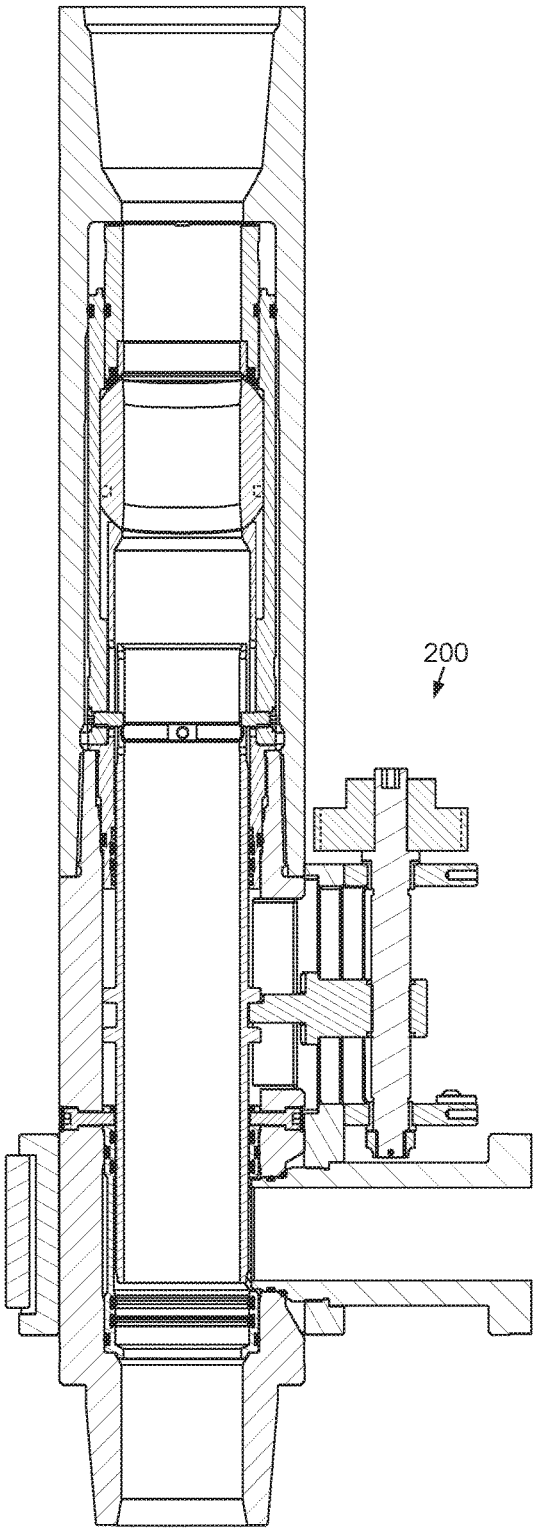
Figure 4C:
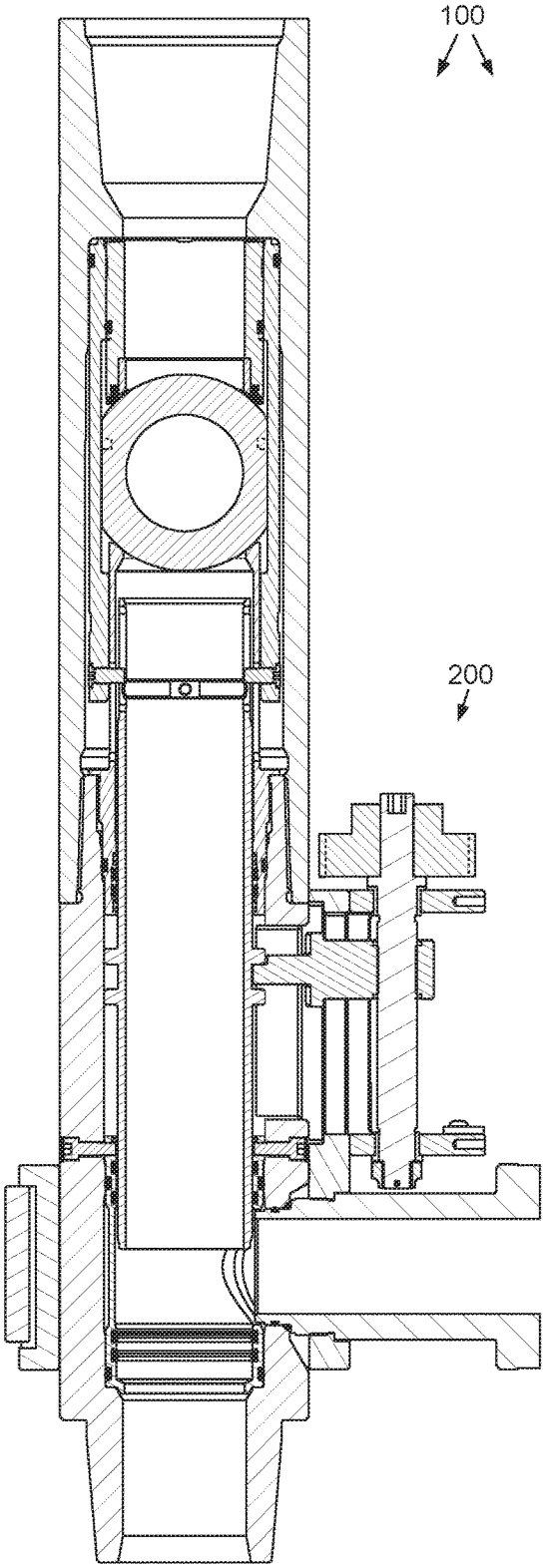
Figure 4D:
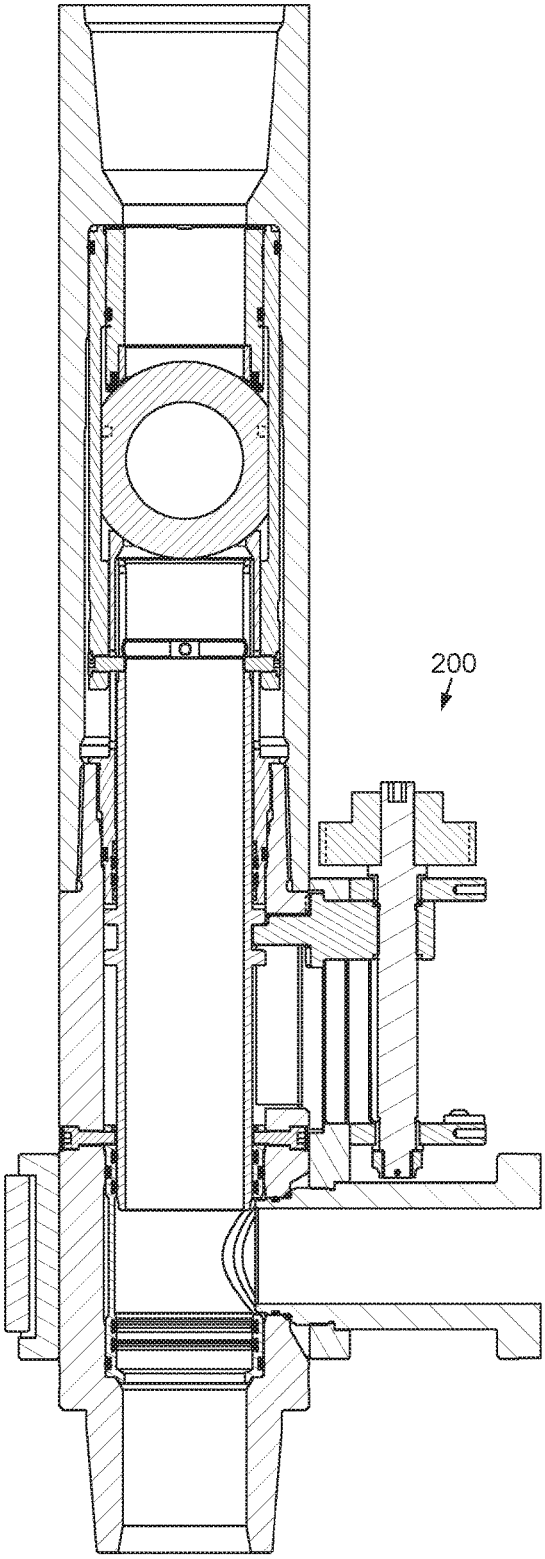
Figure 4E:
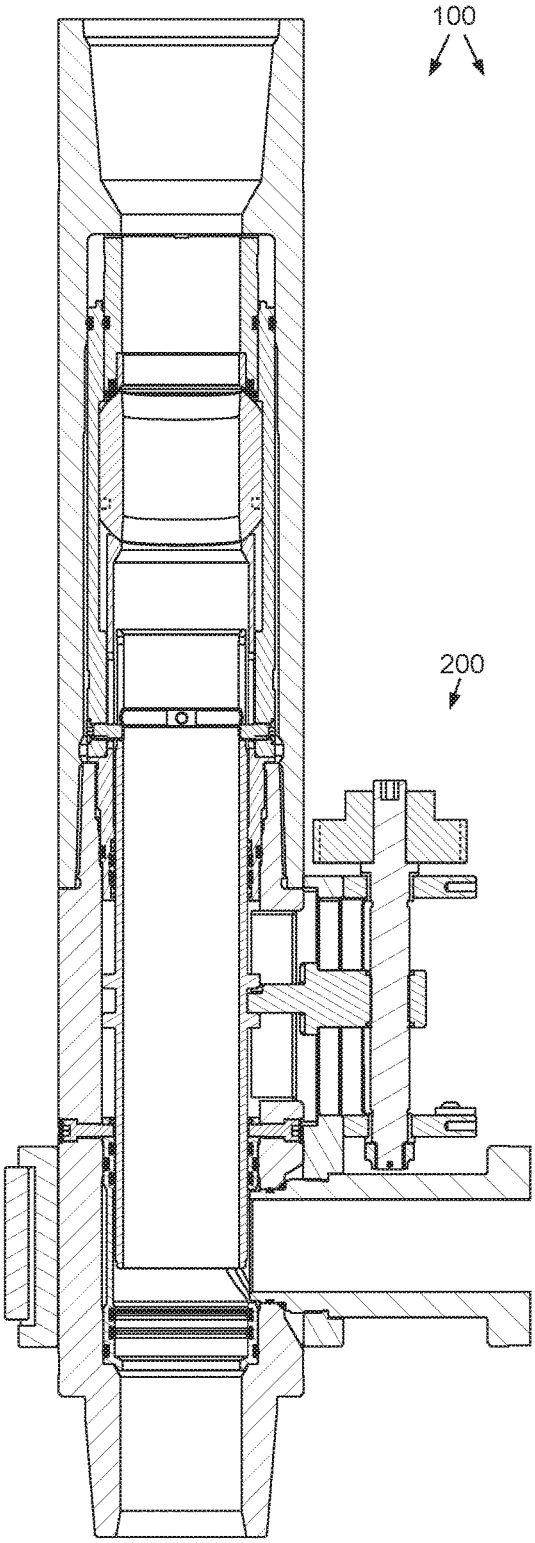

The cam 115 may also interact with the valve sleeve 121 via the linkage. The pins 116 may each be fastened to the cam body 115*b* and each extend into the respective slot 121*s* formed through a wall of the sleeve upper portion 121*u* or vice versa. The split ring 117 may be fastened to the sleeve 121 by being received in a groove formed in an inner surface of the sleeve upper portion 121*u* at a lower portion of the slots 121*s*. The lower cage section 113*b* may have an opening 113*o* formed therethrough for accommodating the cam-sleeve interaction. The linkage may longitudinally connect the cam 115 and the sleeve 121 after allowing a predetermined amount of longitudinal movement therebetween. A stroke of the cam 115 may be less than a stroke of the sleeve 121, such that when coupled with the lag created by the linkage, the bore valve 110 and the port valve 120 may never both be fully closed simultaneously (FIGS. 4B and 4E). Upper seals 124*u* may be disposed between the housing 105 and the cam 115 and between the upper cage section 113*u* and the cam to isolate the interfaces thereof.

FIGS. 3A-3D illustrate the clamp 200. The clamp 200 may include a body 201, a band 202, a latch 205 operable to fasten the band to the body, an inlet 207, one or more actuators, such as port valve actuator 210 and a band actuator 220, and a hub 239. The clamp 200 may be movable between an open position (not shown) for receiving the flow sub 100 and a closed position for surrounding an outer surface of the lower housing segment 105*b*. The body 201 may have a lower base portion 201*b* and an upper stem portion 201*s*. The body 201 may have a coupling, such as a hinge portion, formed at an end of the base portion 201*b*, and the band 202 may have a mating coupling, such as a hinge portion, formed at a first end thereof. The hinge portions may be connected by a fastener, such as a pin 204, thereby pivotally connecting the band 202 and the body 201. The band 202 may have a lap formed at a second end thereof for mating with a complementary lap formed at an end of the latch 205. Engagement of the laps may form a lap joint to circumferentially connect the band 202 and the latch 205.

The body 201 may have a port 201*p* formed through the base portion 201*b* for receiving the inlet 207. The inlet 207 may be connected to the body 201, such as by a threaded connection. A mud saver valve (MSV) 238 may be connected to the inlet 207, such as by a threaded connection. An adapter 231 may be connected to the MSV 238 such as by a threaded connection. The adapter 231 may have a coupling, such as flange, for receiving a flexible conduit, such as bypass hose 31*h*. The inlet 207 may further have one or more seals 208*a,b* and a stab connector 209 formed at an end thereof engaging a seal face of the flow sub 100 adjacent to the side port 101.

The port valve actuator 210 may include the stem portion 201*s*, a bracket 212, a yoke 213, a hydraulic motor 215, and a gear train 216, 217. The body 201 may have a window formed through the stem portion 201*s* and guide profiles, such as tracks 211, formed in an inner surface of the stem portion adjacent to the window. The yoke 213 may extend through the window and have a nut portion 213*n*, slider portion 213*s*, and tongue portion 213*t*. The slider portion 213*s* may be engaged with the tracks 211, thereby allowing longitudinal movement of the yoke 213 relative to the body 201. The yoke 213 may have an engagement profile, such as a lip 213*p*, formed at an end of the tongue portion 213*t* for engaging a groove formed in an outer surface of the lug 121*c*, thereby longitudinally connecting the yoke with the flow sub sleeve 121. The hydraulic motor 215 may have a stator connected to the bracket 212, such as by one or more (four shown) fasteners 214, and a rotor connected to a drive gear 216 of the gear train 216, 217. The motor 215 may be bidirectional.

The drive gear 216 may be connected to a yoke gear 217 by meshing of teeth thereof. The yoke gear 217 may be connected to a lead screw 218, such as by interference fit or key/keyway. The nut portion 213*n* may be engaged with the lead screw 218 such that the yoke 213 may be being raised and lowered by respective rotation of the lead screw. The bracket 212 may be connected to the body 201, such as by one or more (three shown) fasteners 240. The lead screw 218 may be supported by the bracket 212 for rotation relative thereto by one or more bearings 219 (FIG. 4A). The motor 215 may be operable to raise and lower the yoke 213 relative to the body 201, thereby also operating the flow sub sleeve 121 when the clamp 200 is engaged with the flow sub 100 (FIGS. 4A-4F). Alternatively, the motor 215 may be electric or pneumatic.

The band actuator 220 may be operable to tightly engage the clamp 200 with the lower housing section 105*b* after the latch 105 has been fastened. The band actuator 220 may include a bracket 222, a hydraulic motor 225, a bearing 229, and a tensioner 224*a,b*, 226. The tensioner 224*a,b*, 226 may include a tensioner bolt 224*a*, a stopper 224*b*, and a tubular tensioner nut 226. The motor 225 may have a stator connected to the bearing 229, such as by one or more fasteners (not shown) and a rotor connected to a tensioner bolt 224*a*. The motor 225 may be bidirectional. The tensioner bolt 224*a* may be supported from the body 201 for rotation relative thereto by the bearing 229. The bracket 222 may be connected to the body 201, such as by one or more (five shown) fasteners 241. The bearing 229 may be connected to the bracket 222, such as by a fastener 242.

The latch 205 may include an opening formed therethrough for receiving the tensioner nut 226 and a cavity formed therein for facilitating assembly of the tensioner 224*a,b*, 226. To further facilitate assembly, the tensioner nut 226 may be connected to a bar 227, such as by fastener 244*b* and a pin (slightly visible in FIG. 3B). The bar 227 may have a slot formed therethrough to accommodate operation of the tensioner 224*a,b*, 226. The bar 227 may also be connected to the bracket, such as by fastener 244*a*. The tensioner nut 226 may rotate relative to the opening and may have a threaded bore for receiving the tensioner bolt 224*a*. Rotation of the tensioner nut 226 may prevent binding of the tensioner bolt 224*a* and may allow replacement due to wear. A stopper 224*b* may be connected to the bolt 224*a* with a threaded connection. To engage the clamp 200 with the flow sub 100, the body 201 may be aligned with the flow sub 100, the band 202 wrapped around the flow sub 100 and the latch 205 engaged with the band 202. The motor 225 may then be operated, thereby tightening the clamp 200 around the lower housing section 105*b*. Alternatively, the motor 225 may be electric or pneumatic.

To facilitate manual handling, the clamp 200 may further include one or more handles 230*a-d*. A first handle 230*a* may be connected to the band 202, such as by a fastener. Second 230*b* and third 230*c* handles may be connected to the latch 205, such as by respective fasteners. A fourth handle 230*d* may be connected to the bracket 222, such as by a fastener. A hub 239 may be connected to the bracket 212, such as by one or more (two shown) fasteners 243. The hub 239 may include one or more (four shown) hydraulic connectors 245 for receiving respective hydraulic lines 31*c* from the hydraulic manifold 39. The hub 239 may also include internal hydraulic conduits (not shown), such as tubing, connecting the connectors 245 to respective inlets and outlets of the hydraulic motors 215, 225.

Each hydraulic motor 215, 225 may further include a motor lock operable between a locked position and an unlocked position. Each motor lock may include a clutch torsionally connecting the respective rotor and the stator in the locked position and disengaging the respective rotor from the respective stator in the unlocked position. Each clutch may be biased toward the locked position and further include an actuator, such as a piston, operable to move the clutch to the unlocked position in response to hydraulic fluid being supplied to the respective motor. Alternatively each lock may have an additional hydraulic port for supplying the actuator.

Alternatively, the band 202 and latch 205 may be replaced by automated (i.e., hydraulic) jaws. Additionally, the clamp 200 may be deployed using a beam assembly. The beam assembly may include a one or more fasteners, such as bolts, a beam, such as an I-beam, a fastener, such as a plate, and a counterweight. The counterweight may be clamped to a first end of the beam using the plate and the bolts. A hole may be formed in the second end of the beam for connecting a cable (not shown) which may include a hook for engaging the hoist ring. One or more holes (not shown) may be formed through a top of the beam at the center for connecting a sling which may be supported from the derrick 3 by a cable. Using the beam assembly, the clamp 200 may be suspended from the derrick 3 and swung into place adjacent the flow sub 100 when needed for adding stands 10*s* to the drill string 10 and swung into a storage position during drilling.

Alternatively, the clamp 200 may be deployed using a telescopic arm. The telescopic arm may include a piston and cylinder assembly (PCA) and a mounting assembly. The PCA may include a two stage hydraulic PCA mounted internally of the arm which may include an outer barrel, an intermediate barrel and an inner barrel. The inner barrel may be slidably mounted in the intermediate barrel which is, may be in turn, slidably mounted in the outer barrel. The mounting assembly may include a bearer which may be secured to a beam by two bolt and plate assemblies. The bearer may include two ears which accommodate trunnions which may project from either side of a carriage. In operation, the clamp 200 may be moved toward and away from the flow sub 100 by extending and retracting the hydraulic piston and cylinder.

FIGS. 4A-4F illustrate operation of the flow sub 100 and the clamp 200. FIG. 5A illustrates the drilling system 1 in a bypass mode. FIGS. 5B and 5C illustrate operation of the drilling system. Referring specifically to FIG. 5A, the MSV 238 may be manually operated. A position sensor 250 may be operably coupled to the MSV 238 for determining a position (open or closed) of the MSV. The position sensor 250 may be in data communication with the PLC 75. Alternatively, the MSV 238 may be automated.

The fluid handling system 1*h* may further include a second HPU 30*h* and a second manifold 39. Although two HPUs 30*h* and two manifolds 39 are shown for operation of the clamp 200, the clamp 200 may be operated with only one HPU and one manifold as shown in FIG. 1A. Each HPU 30*h* may include a pump, an accumulator, a check valve, a reservoir having hydraulic fluid, and internal hydraulic conduits connecting the pump, reservoir, accumulator, and check valve. Each HPU 30*h* may further include a pressurized port in fluid communication with the respective accumulator and a drain port in fluid communication with the reservoir. Each hydraulic manifold 39 may include one or more automated shutoff valves 39*a-d*, 39*e-h* in communication with the PLC 75. Each manifold 39 may have a pressurized inlet in connected to a first respective pair of the shutoff valves and a drain inlet in fluid communication with a second respective pair of shutoff valves. Each manifold 39 may also have first and second outlets, each outlet connected to a shutoff valve of each pair. A first portion of the hydraulic lines 31*c* may connect respective inlets of the manifolds to respective inlets of the HPUs. A second portion of the hydraulic lines 31*c* may connect respective outlets of the manifolds to respective hydraulic connectors 245 of the clamp hub 239. Alternatively, each manifold 39 may include one or more directional control valves, each directional control valve consolidating two or more of the shutoff valves 39*a-h*.

Referring specifically to FIGS. 4A, and 5A-5C, once it is necessary to extend the drill string 10, drilling may be stopped by stopping advancement and rotation 16 of the top drive 5 and removing weight from the drill bit 15. A spider (not shown) may then be operated to engage the drill string 10, thereby longitudinally supporting the drill string 10 from the rig floor 4. The clamp 200 may then be transported to the flow sub 100 and closed around the flow sub lower housing section 105*b*. The PLC 75 may then operate the band actuator 220 by opening manifold valves 39*a,d*, thereby supplying hydraulic fluid to the band motor 225. Operation of the band motor 225 may rotate the tensioner bolt 224*a*, thereby tightening the clamp 200 into engagement with the flow sub lower housing 105*b*. The PLC 75 may then lock the band motor 225. The MSV 238 may be manually opened and then the rig crew may evacuate the rig floor 4.

The PLC 75 may then test engagement of the seals 208*a,b* by closing the bypass drain valve 38*d* and by opening the bypass valve 38*b* to pressurize the clamp inlet 207 and then closing the bypass valve. If the clamp seals 208*a,b* are not securely engaged with the lower housing section 105*b*, drilling fluid 60*d* will leak past the clamp seals. The PLC 75 may verify sealing integrity by monitoring the bypass pressure sensor 35*b*. The PLC may then reopen the bypass valve 38*b* to equalize pressure on the valve sleeve 121. The PLC 75 may then operate the port valve actuator 210 by opening manifold valves 39*f,h*, thereby supplying hydraulic fluid to the port motor 215. Operation of the port motor 215 may rotate the lead screw 218, thereby raising the yoke 213.

Referring specifically to FIG. 4B, when moved upwardly by the yoke 213, the sleeve 121 may move longitudinally relative to the cam 115 until the split ring 117 engages the pins 116, thereby longitudinally connecting the sleeve and the cam. Referring specifically to FIGS. 4C and 4D, upward movement of the sleeve 121 and the cam 115 may continue, thereby closing the bore valve 110. Due to the lag, discussed above, drilling fluid 60*d* may momentarily flow into the drill string 10 through both the side port 101 and the bore valve 110. The upward movement may continue until a top of the cam 115 engages the upper housing shoulder 103*u*. The split ring 117 may then be pushed radially inward by further engagement with the pins 116, thereby freeing the cam 115 from the sleeve 121. Upward movement of the sleeve 121 (without the cam 115) may continue until an upper shoulder of the yoke 213 engages an upper shoulder of the stem portion 201*s* at which point the side port 101 is fully open.

Referring specifically to FIGS. 5A-5C, once the side port 101 is fully open, the PLC 75 may lock the port motor 215 and relieve pressure from the top drive 5 by closing the supply valve 38*a* and opening the supply drain valve 38*c*. The PLC 75 may then test integrity of the closed bore valve 110 by closing the supply drain valve 38*d*. If the bore valve 110 has not closed, drilling fluid 60*d* will leak past the bore valve. The PLC 75 may verify closing of the bore valve 110 by monitoring the supply pressure sensor 35*d*. The top drive 5 may then be operated to disconnect from the flow sub 100 and to hoist a stand 10*s* from pipe rack 17. Each stand 10*s* may include the flow sub 100 and one or more joints of drill pipe 10*p*. The flow sub 100 may be assembled to form an upper end of the respective stand 10*s*. The top drive 5 may continue to be operated to connect to the flow sub 100 of the retrieved stand 10*s*. The top drive 5 may then be operated to connect a lower end of the stand 10*s* to the flow sub 100 of the drill string 10. Drilling fluid 60*d* may continue to be injected into the side port 101 (via the open supply valve 38*b* and MSV 238) during adding of the stand 10*s* by the top drive 5 at a flow rate corresponding to the flow rate in drilling mode. The PLC 75 may also utilize the bypass flow meter 34*b* for performing the mass balance to monitor for a kick or lost circulation during adding of the stand 10*s*.

Once the stand 10*s* has been added to the drill string 10, the PLC 75 may pressurize the added stand 10*s* by closing the supply drain valve 38*c* and opening the supply valve 38*a*. Once the stand 10*s* has been pressurized, the PLC 75 may then unlock the port motor 215. The PLC 75 may then reverse operate the port valve actuator 210 by opening manifold valves 39*e,g*, thereby reversing supply of the hydraulic fluid to the port motor 215. Operation of the port motor 215 may counter-rotate the lead screw 218, thereby lowering the yoke 213.

Figure 4F:
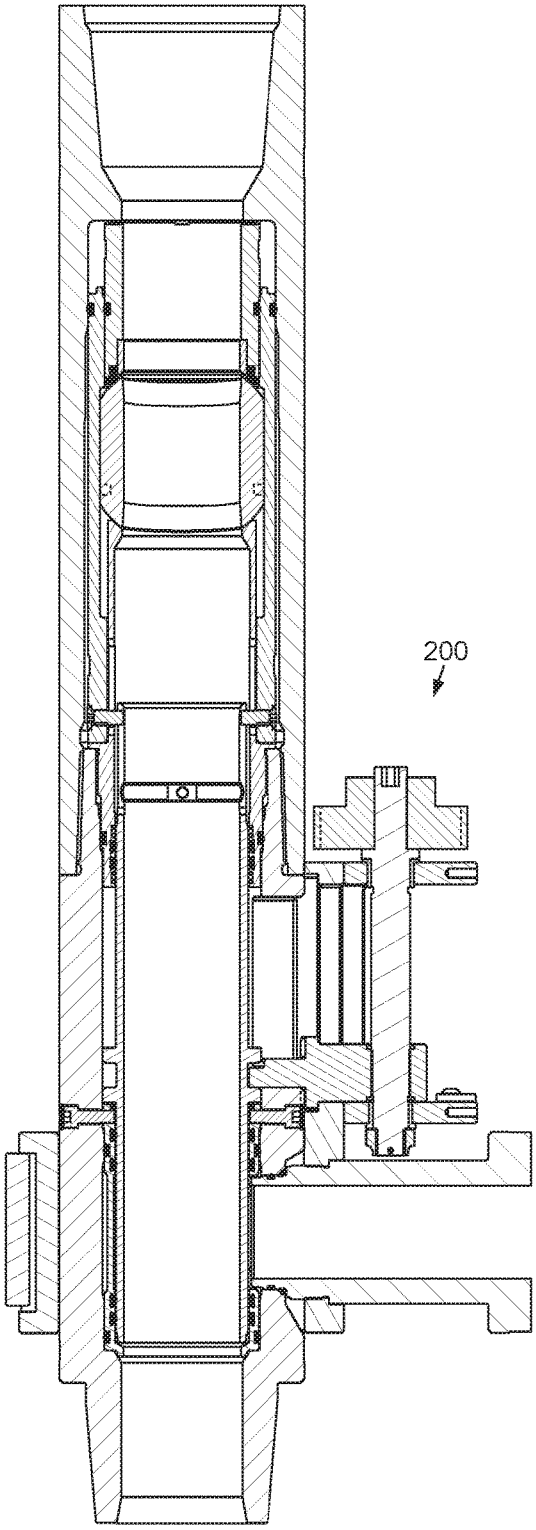
Figure 5A:
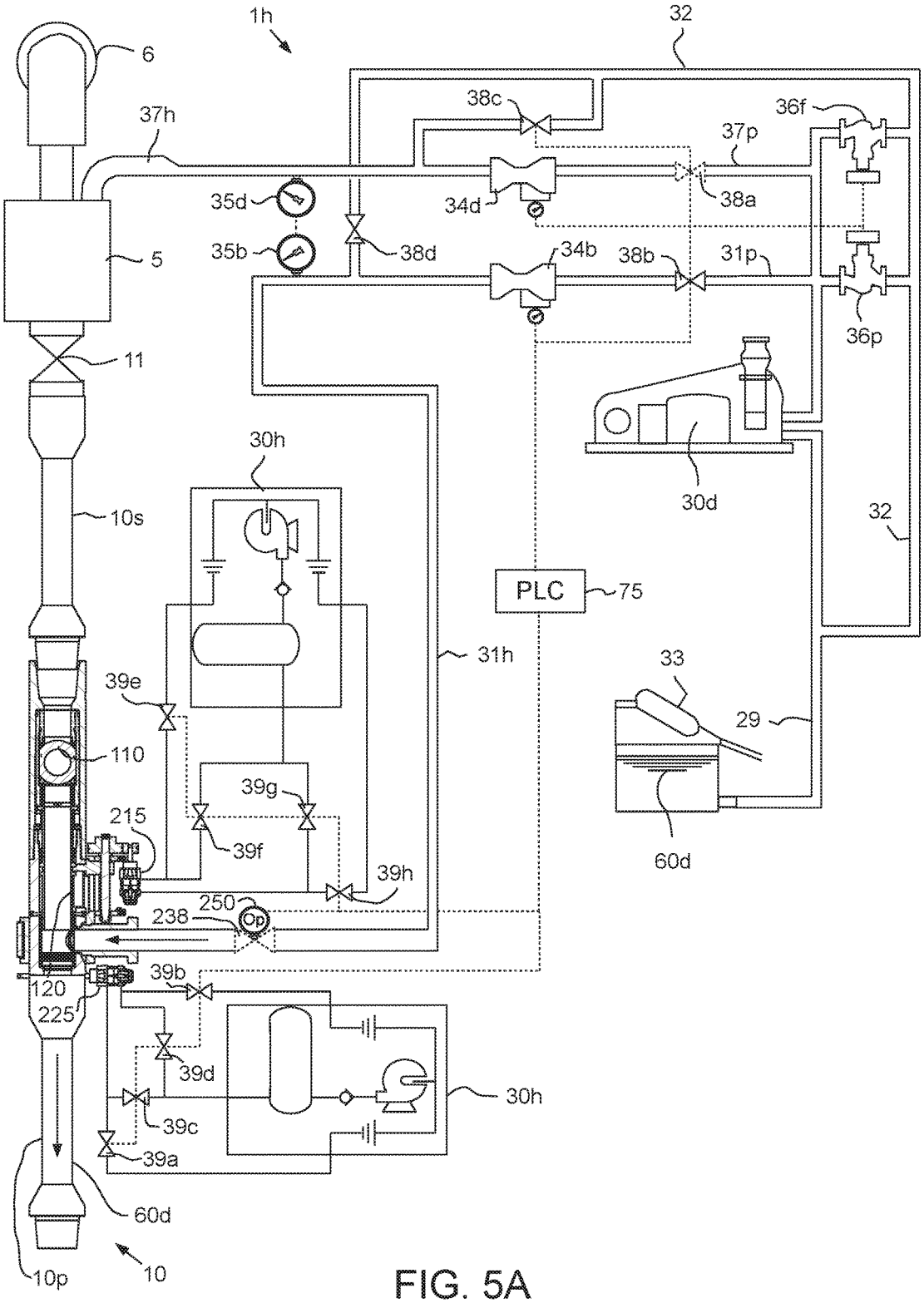
FIG. 5A illustrates the drilling system in a bypass mode.

Referring specifically to FIGS. 4E and 4F, when moved downwardly by the yoke 213, the sleeve 121 may move longitudinally relative to the cam 115 until the split ring 117 engages the pins 116, thereby longitudinally connecting the sleeve and the cam. Downward movement of the sleeve 121 and the cam 115 may continue, thereby opening the bore valve 110. Due to the lag, discussed above, drilling fluid 60*d* may momentarily flow into the drill string 10 through both the side port 101 and the bore valve 110. The downward movement may continue until a bottom of the cam 115 engages a shoulder of the lower cage section 113*b*. The split ring 117 may then be pushed radially inward by further engagement with the pins 116, thereby freeing the cam 115 from the sleeve 121. Downward movement of the sleeve 121 (without the cam 115) may continue until a lower shoulder of the yoke 213 engages a lower shoulder of the stem portion 201*s* at which point the side port 101 is fully closed.

Referring specifically to FIGS. 5A-5C, once the side port 101 is fully closed, the PLC 75 may then relieve pressure from the clamp inlet 207 by closing the bypass valve 38*b* and opening the bypass drain valve 38*d*. The PLC 75 may then confirm closure of the port sleeve 121 by closing the bypass drain valve 38*d* and monitoring the bypass pressure sensor 35*b*. Once closure of the port sleeve 121 has been confirmed, the PLC 75 may open the bypass drain valve 38*d*. The rig crew may then return to the rig floor 4 and close the MSV 238. The PLC 75 may then unlock the band motor 225. The PLC 75 may then reverse operate the band actuator 220 by opening manifold valves 39*b,c*, thereby reversing supply of hydraulic fluid to the band motor 225. Operation of the band motor 225 may counter-rotate the tensioner bolt 224*a*, thereby loosening the clamp 200 from engagement with the flow sub lower housing 105*b*. The clamp 200 may then be opened and transported away from the flow sub 100. The spider may then be operated to release the drill string 10. Once released, the top drive 5 may be operated to rotate 16 the drill string 10. Weight may be added to the drill bit 15, thereby advancing the drill string 10 into the wellbore 90 and resuming drilling of the wellbore. The process may be repeated until the wellbore 90 has been drilled to total depth or to a depth for setting another string of casing.

A similar process may be employed if/when the drill string 10 needs to be tripped, such as for replacement of the drill bit 15 and/or to complete the wellbore 90. To disassemble the drill string 10, the drill string may be raised (while circulating drilling fluid via the top drive 5) until one of the flow subs 100 is at the rig floor 4. The spider may be set (if rotating 16 while tripping, rotation may be halted before setting the spider). The clamp 200 may be installed and tested. The drilling fluid flow may be switched to the clamp 200 and the bore valve 110 tested. The top drive 5 may then be operated to disconnect the stand 10*s* extending above the rig floor 4 and to hoist the stand to the pipe rack 17. The top drive 5 may then be connected to the flow sub 100 at the rig floor 4. The top drive 5 may then be pressurized and the drilling fluid flow switched to the top drive. The clamp 200 may be bled, the port valve tested, and the clamp removed. Tripping of the drill string from the wellbore may then continue until the drill bit 15 reaches the LMRP. At that point, the BOPs may be closed and circulation may be maintained using the booster 27 and choke 28 lines.

Alternatively, the method may be utilized for running casing or liner to reinforce and/or drill the wellbore 90, or for assembling work strings to place downhole components in the wellbore.

Alternatively, the pins 116 may be radially movable relative to the cam 115 between an extended position and a retracted position and be biased toward the retracted position by biasing members, such as springs. A recess formed in an inner surface of the upper housing section may allow the pins 116 to retract. The pins 116 may still engage the slots 121*s* in the retracted position but may be clear of the split ring 117. The cam 115 and sleeve 121 may be longitudinally connected during the upper stroke by the pins engaging a bottom of the respective slots. Once the cam 115 moves upward, the upper housing inner surface may force the pins 116 to extend. The extended pins 116 may then catch the split ring 117 on the downward stroke until the pins are aligned with the housing recess. Alternatively, the split ring 117 may be movable between an extended position and a retracted position by engagement with an inclined surface formed in an inner surface of the lower cage section 113*b*.

In another embodiment (not shown) discussed at paragraphs [0041]-[0056] and illustrated at FIGS. 6A-11 of the '322 provisional application, the port valve actuator 210 may include a piston and cylinder assembly (PCA) instead of the hydraulic motor 215 and the band actuator 220 may include a PCA and a first hinge segment instead of the hydraulic motor 225, tensioner 224*a,b*, 232, and latch 205. The modified clamp may include a second band pivotally connected to the band 202 at a first end thereof and having a second hinge segment complementing the first hinge segment formed at a second end thereof. A cylinder of the port PCA may be connected to the clamp body 201, such as by fastening. A piston of the port PCA may be connected to the yoke 213, such as by fastening. The port PCA may be operable to raise and lower the yoke 213 relative to the body 201 when the modified clamp is engaged with a modified flow sub (FIGS. 8A-9B of the '322 provisional).

In this PCA embodiment, a longitudinal centerline of the port PCA may be offset from a longitudinal centerline of the stem portion 201*s* and the flow sub window 102 may be correspondingly offset from the flow sub port 101. A cylinder of the band PCA may be connected to the clamp body 201, such as by fastening. A piston of the band PCA may be connected to the first hinge segment, such as by a threaded connection. The band PCA may be connected to the second band by insertion of a fastener, such as hinge pin, through the first and second hinge segments. To engage the modified clamp with the modified flow sub, the clamp body 201 may be aligned with the modified flow sub, the bands wrapped around the flow sub and the hinge pin inserted through the hinge segments. The band PCA may then be retracted, thereby tightening the modified clamp around the lower housing section of the modified flow sub.

In another embodiment (not shown) discussed at paragraph [0057] and illustrated at FIGS. 12A and 12B of the '322 provisional application, the flow sub PCA of the modified clamp may be connected to the stem portion 201*s* such that the longitudinal centerline of the flow sub PCA is aligned with the longitudinal centerline of the stem portion 201*s* and the further modified clamp may be used with the flow sub 100 (without modification).

Figure 6:
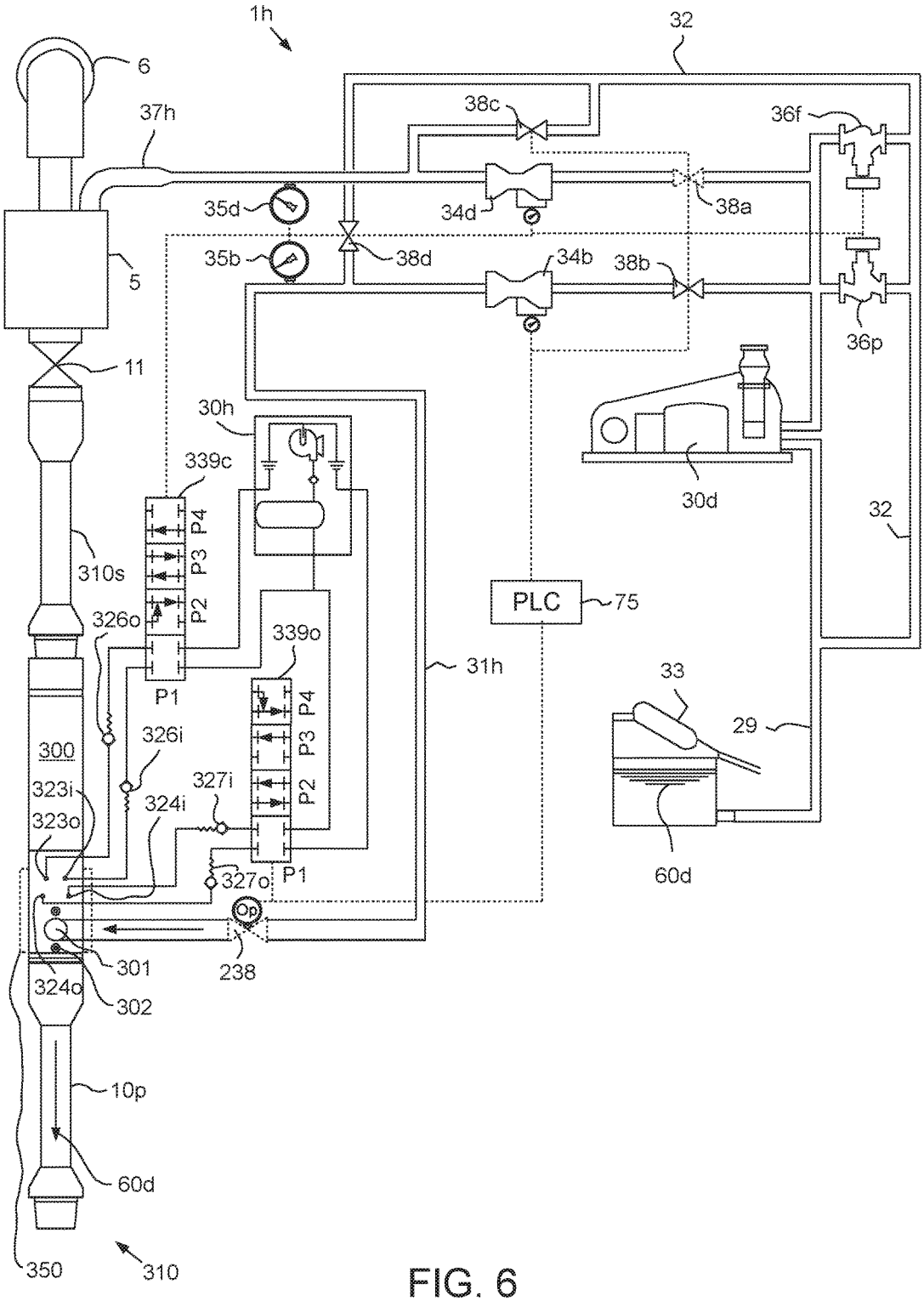
FIG. 6 illustrate a flow sub and clamp, according to another embodiment of the present invention.

FIG. 6 illustrate a flow sub 300 and clamp 350, according to another embodiment of the present invention. The flow sub 300 may include a tubular housing, a bore valve (not shown, see FIGS. 2A-2C of the '322 provisional application), a bore valve actuator (not shown, see FIGS. 2A-2C of the '322 provisional application), a side port valve (not shown, see FIGS. 2A-2C of the '322 provisional application), and a side port valve actuator. The bore valve and bore valve actuator may be similar to those of the flow sub 100.

Instead of being actuated by mechanical interaction with the clamp, the port valve may be actuated by hydraulic interaction with the clamp 350. The port valve actuator may be hydraulic and include a piston (not shown, see FIGS. 2A-2C of the '322 provisional application), one or more hydraulic ports, such as opener inlet 324*i* and outlet 324*o* ports and closer inlet 323*i* and outlet 323*o* ports, one or more seals, one or more hydraulic chambers (not shown, see FIGS. 2A-2C of the '322 provisional application), such as an opener and a closer, one or more hydraulic valves 326*i,o*, 327*i,o*. The piston may be integral with the sleeve (not shown, see FIGS. 2A-2C of the '322 provisional application) or be a separate member connected thereto, such as by fastening. The piston may be disposed in a lower annulus of the flow sub housing and may divide the lower annulus into the two hydraulic chambers. Seals (not shown) may be disposed as needed to isolate the hydraulic chambers. Alternatively, the port valve actuator may include a biasing member, such as a spring, for closing instead of the closer chamber, ports, and valves.

The hydraulic ports 323*i,o*, 324*i,o* may extend radially and circumferentially through a wall of a lower housing section of the flow sub 300 to accommodate placement of the hydraulic valves 326*i,o*, 327*i,o*. Each hydraulic valve 326*i,o*, 327*i,o* may be disposed in a respective hydraulic port 323*i,o*, 324*i,o*. The hydraulic valves 326*i,o*, 327*i,o* are shown externally of the ports for the sake of clarity only. The inlet hydraulic valves 326*i*, 327*i* may each be a check valve operable to allow hydraulic fluid flow from the HPU 30*h* to the hydraulic chambers and prevent reverse flow from the chambers to the HPU. Each check valve may include a spring having substantial stiffness so as to prevent return fluid from entering the respective chamber should an annulus pressure spike occur while the flow sub 300 is in the wellbore 90. The outlet hydraulic valves 326*o*, 327*o* may each be a pressure relief valve operable to allow hydraulic fluid flow from the respective hydraulic chamber to the HPU 30*h* when pressure in the chamber exceeds pressure in the HPU by a predetermined differential pressure. The differential pressure may be set to be equal to or substantially equal to the drilling fluid pressure so that the pressure in the hydraulic chambers remains equal to or slightly greater than the drilling fluid pressure, thereby ensuring that drilling fluid 60*d* does not leak into the hydraulic chambers.

The clamp 350 may include a body, one or more bands pivoted to the body, such as by a hinge (not shown), and a latch (not shown) operable to fasten the bands to the body. The clamp 350 may be movable between an open position for receiving the flow sub 300 and a closed position for surrounding an outer surface of the flow sub lower housing segment. The clamp 350 may further include a tensionser (not shown) operable to tightly engage the clamp with the flow sub lower housing section after the latch has been fastened. The clamp body may have a circulation port (not shown) formed therethrough and hydraulic ports (not shown) formed therethrough corresponding to the respective hydraulic ports 323*i,o*, 324*i,o*. The clamp body may further have an inlet for connection to the MSV 238. The clamp body may further have a gasket disposed in an inner surface thereof and having openings corresponding to the body ports. When engaged with the flow sub lower housing section, the gasket may provide sealed fluid communication between the clamp body ports and respective lower housing ports 301, 323*i,o*, 324*i,o*. Each of the clamp body and the flow sub lower housing section may further include mating locator profiles, such as a dowels (not shown) and mating recesses 302 formed in an outer surface of the lower housing section (or vice versa) for alignment of the clamp body with the lower housing section.

The HPU 30*h* may be connected to the flow sub 300 via the clamp 350. The manifold may include an opener control valve 3390 and a closer control valve 339*c*. The control valves 339*o,c* may each be directional valves having an electric, hydraulic, or pneumatic actuator in communication with the PLC 75. Each control valve 310*o,c* may be operable between two or more positions P1-P4 and may fail to the closed position P1. In the open positions P2-P4, each control valve 310*o,c* may selectively provide fluid communication between one or more of the flow sub hydraulic valves 326*i,o*, 327*i,o* and one or more of the HPU accumulator and HPU reservoir.

In operation, once it is necessary to extend the drill string 310, drilling may be stopped by stopping advancement and rotation of the top drive 5 and removing weight from the drill bit 15. The spider may then be operated to engage the drill string, thereby longitudinally supporting the drill string 310 from the rig floor 4. The clamp 350 may be transported to the flow sub 300, closed, and tightened to engage the flow sub lower housing section. The PLC 75 may then test engagement of the clamp 350 by closing the bypass drain valve 38*d* and by opening the bypass valve 38*b* and MSV 238 to pressurize the clamp inlet and then closing the bypass valve. If the gasket is not securely engaged with the flow sub lower housing section, drilling fluid 60*d* will leak past the gasket. The PLC 75 may verify sealing integrity by monitoring the bypass pressure sensor 35*b*. The PLC may then reopen the bypass valve 38*b* to equalize pressure on the flow sub valve sleeve.

The PLC 75 may then operate the port valve actuator by opening the opener control valve 310*o* to the second position P2, thereby providing fluid communication between the HPU accumulator and the opener inlet valve 327*i* and between the HPU reservoir and the opener outlet valve 327*o*. The HPU accumulator may then inject hydraulic fluid into the flow sub opener chamber. Once pressure in the opener chamber exceeds the differential pressure, hydraulic fluid may exit the opener chamber through the opener outlet valve 327*o* to the HPU reservoir, thereby displacing any air from the opener chamber. Once the opener chamber has been bled, the PLC 75 may shift the opener control valve 310*o* to the third position P3 and open the closer control valve 310*c* to the second position P2, thereby providing fluid communication between the HPU accumulator and the opener inlet valve 327*i*, preventing fluid communication between the HPU reservoir and the opener outlet valve 327*o*, and providing fluid communication between both closer valves 326*i,o* and the HPU reservoir. The HPU accumulator may then inject hydraulic fluid into the flow sub opener chamber.

Once pressure in the flow sub opener chamber exerts a fluid force on a lower face of the flow sub piston sufficient to overcome differential pressure of the closer chamber, the flow sub port sleeve may move upward to the open position, thereby also closing the flow sub bore valve. Due to the lag, discussed above, drilling fluid 60*d* may momentarily flow into the drill string 310 through both the side port and the bore valve. The PLC 75 may verify opening of the port sleeve by monitoring the supply 34*b* and/or bypass 34*b* flow meters. The PLC 75 may then test integrity of the closed bore valve by closing the supply valve 38*a* and by opening the supply drain valve 38*c* to relieve pressure from the top drive 5 and then closing the supply drain valve. The PLC 75 may verify closing of the bore valve by monitoring the supply pressure sensor 35*d*. The top drive 5 may then be operated to disconnect from the flow sub 300 and to hoist a stand 310*s* from pipe rack 17. The top drive 5 may continue to be operated to connect to the flow sub (not shown, see flow sub 300) of the retrieved stand 310*s*. The top drive 5 may then be operated to connect a lower end of the stand 310*s* to the flow sub 300 of the drill string 310. Drilling fluid 60*d* may continue to be injected into the side port (via the open supply valve 38*b* and MSV 238) during adding of the stand 310*s* by the top drive 5 at a flow rate corresponding to the flow rate in drilling mode. The PLC 75 may also utilize the bypass flow meter 34*b* for performing the mass balance to monitor for a kick or lost circulation during adding of the stand 310*s*.

Once the stand 310*s* has been added to the drill string 310, the PLC 75 may pressurize the added stand 310*s* by closing the supply drain valve 38*c* and opening the supply valve 38*a*. The PLC 75 may then shift the opener control valve 310*o* to the fourth position P4 and shift the closer control valve 310*c* to the third position P3, thereby providing fluid communication between the HPU accumulator and the closer inlet valve 326*i*, providing fluid communication between the HPU reservoir and the closer outlet valve 326*o*, and providing fluid communication between both opener valves 327*i,o* and the HPU reservoir. Once the flow sub opener chamber has been relieved and the flow sub closer chamber has been bled, the PLC 75 may shift the closer control valve 310*c* to the fourth position P4, thereby providing fluid communication between the HPU accumulator and the closer inlet valve 326*i* and preventing fluid communication between the HPU reservoir and the closer outlet valve 326*o*. The HPU accumulator may then inject hydraulic fluid into the flow sub closer chamber.

Once pressure in the flow sub closer chamber exerts a fluid force on an upper face of the flow sub piston sufficient to overcome the pressure differential of the opener outlet 327*o*, the flow sub port sleeve may move downward to the closed position, thereby also opening the flow sub bore valve. Due to the lag, discussed above, drilling fluid 60*d* may momentarily flow into the drill string 310 through both the side port 302 and the flow sub bore valve. The PLC 75 may verify closing of the flow sub port sleeve by monitoring the supply 34*b* and/or bypass 34*b* flow meters.

Once the side port 101 is fully closed, the PLC 75 may then relieve pressure from the clamp inlet 207 by closing the bypass valve 38*b* and opening the bypass drain valve 38*d*. The PLC 75 may then confirm closure of the flow sub port sleeve by closing the bypass drain valve 38*d* and monitoring the bypass pressure sensor 5*b*. Once closure of the port sleeve 121 has been confirmed, the PLC 75 may close P1 both control valves 310*o,c* and open the bypass drain valve 38*d*. The clamp 350 may then be loosened from engagement with the flow sub lower housing. The clamp 350 may then be opened and transported away from the flow sub 300. The spider may then be operated to release the drill string 310. Once released, the top drive 5 may be operated to rotate 16 the drill string 310. Weight may be added to the drill bit 15, thereby advancing the drill string 310 into the wellbore 90 and resuming drilling of the wellbore. The process may be repeated until the wellbore 90 has been drilled to total depth or to a depth for setting another string of casing.

Figures 7A, 7B:
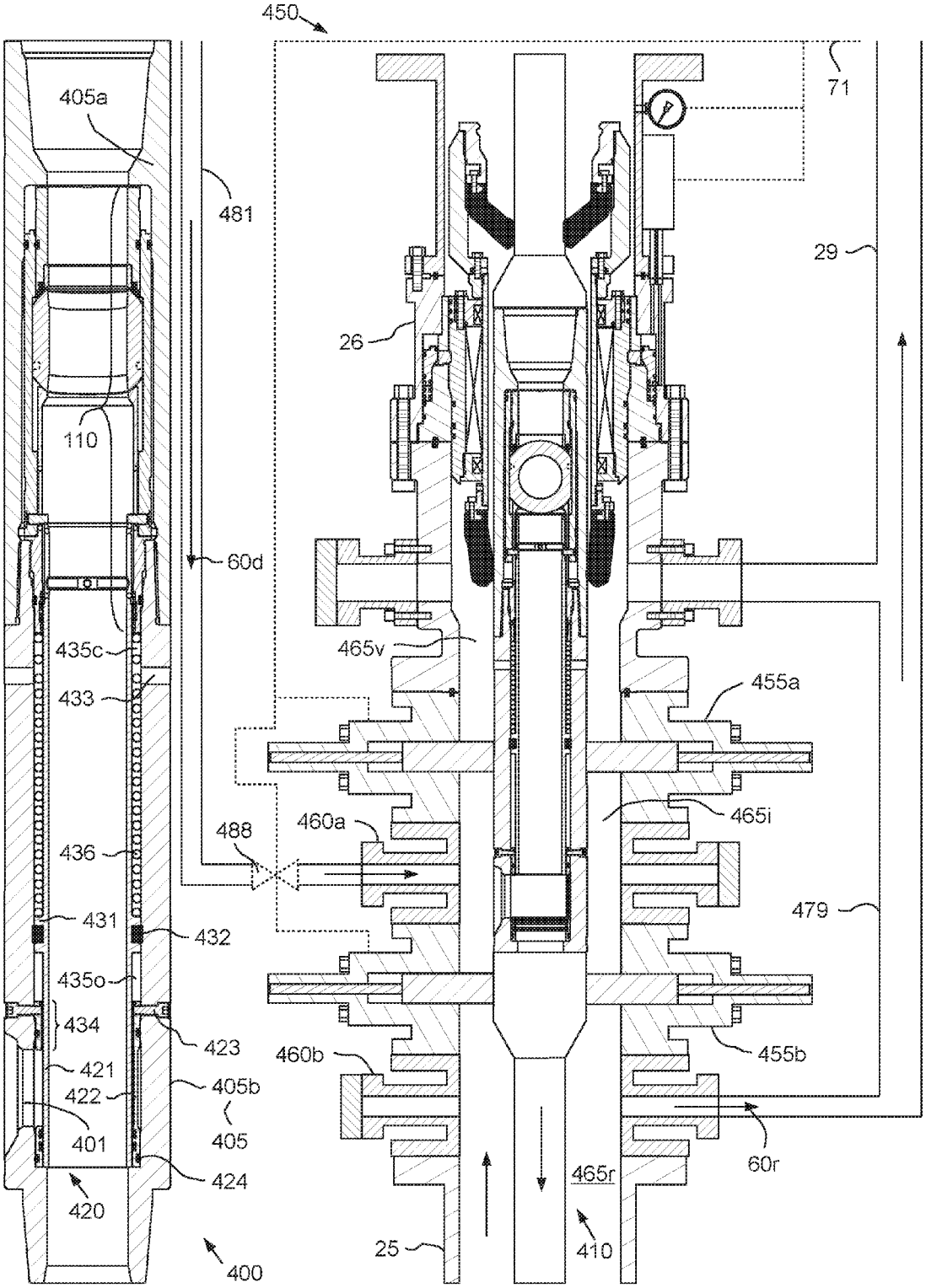
FIG. 7A illustrates a flow sub, according to another embodiment of the present invention.
FIG. 7B illustrates operation of the flow sub with an upper marine riser package (UMRP).

FIG. 7A illustrates a flow sub 400, according to another embodiment of the present invention. FIG. 7B illustrates operation of the flow sub 400 with a UMRP 450. The flow sub 400 may include a tubular housing 405, the bore valve 110, the bore valve actuator, a side port valve 420, and a side port valve actuator. The housing 405 may include one or more sections 405*a,b* each section connected together, such as by fastening with a threaded connection. The housing 405 may have a central longitudinal bore therethrough and a radial flow port 401 formed through a wall thereof in fluid communication with the bore and located at a side of one of the housing sections 405*b*. The housing 405 may also have a threaded coupling formed at each longitudinal end, such as a box formed in an upper longitudinal end and a pin formed on a lower longitudinal end, so that the housing may be assembled as part of the drill string 410.

The port valve 420 may include a closure member, such as a sleeve 421, and a seal mandrel 422. The seal mandrel 422 may be made from an erosion resistant material, such as tool steel, ceramic, or cermet. The seal mandrel 422 may be disposed within the housing 405 and connected thereto, such as by one or more (two shown) fasteners 423. The seal mandrel 422 may have a port formed through a wall thereof corresponding to and aligned with the housing port 401. Seals 424 may be disposed between the housing 405 and the seal mandrel 422 and between the seal mandrel and the sleeve 421 to isolate the interfaces thereof. The port valve 420 may have a maximum allowable flow rate greater than, equal to, or slightly less than a flow rate of the drilling fluid 60*d* in drilling mode. The sleeve 421 may be disposed within the housing 405 and longitudinally movable relative thereto between an open position (FIG. 7B) and a closed position (FIG. 7A) by the port valve actuator.

The port valve actuator may be hydraulic and include a piston 431, a hydraulic port 433, a hydraulic passage 434, a piston seal 432, one or more hydraulic chambers, such as an opener 435*o* and a closer 435*c*, and a biasing member, such as a spring 436. The piston 431 may be integral with the sleeve 421 or be a separate member connected thereto, such as by fastening. The piston 431 may be disposed in a lower annulus of the housing and may divide the lower annulus into the two hydraulic chambers 435*o,c*. The piston seal 432 may be carried by the piston 431 and may isolate the chambers 435*o,c*. The spring 436 may be disposed in the closer chamber 435*c* and against the piston 431, thereby biasing the sleeve 421 toward the closed position. The hydraulic passage 434 may be formed between the sleeve 421 and the seal mandrel 422 and may provide fluid communication between the side port 401 and the opener chamber 435*o*.

In the open position, the side port 401 may be in fluid communication with a lower portion of the housing bore. In the closed position, the sleeve 421 may isolate the side port 401 from the housing bore by engagement with the seals 424 of the seal sleeve 422. During drilling, the chambers 435*o,c* may be balanced due to the closer chamber 435*c* being in fluid communication with the returns 60*r* via the hydraulic port 433 and the opener chamber 435*o* also being in fluid communication with the returns via the passage 434 and the side port 401. The spring 436 may therefore be unopposed in keeping the side port valve 420 in the closed position.

Instead of being operated by hydraulic fluid, the port valve actuator may be operated by drilling fluid 60*d* selectively injected and relieved from the chambers 435*o,c*. The UMRP 450 may include the diverter (not shown, see diverter 21), the flex joint (not shown, see flex joint 22), the slip joint (not shown, see slip joint 23), the tensioner (not shown, see tensioner 24), the RCD 26, one or more BOPs 455*a,b*, and one or more flow crosses 460*a,b*. The BOPs 455*a,b* may be operated between an engaged position (FIG. 7B) and a disengaged position (not shown). The BOPs 455*a,b* may be ram type (shown) or annular type (not shown). The BOPs 455*a,b* may be operable to extend into engagement with and seal against an outer surface of the flow sub housing 405, thereby dividing an annulus formed between the flow sub 400 and the UMRP 450 into a vent chamber 465*v*, a an injection chamber 465*i*, and a returns chamber 465*r*. The BOPs and shutoff valve 488 may be operated by the PLC 75 via the auxiliary umbilical 71 and the auxiliary HPU.

The shutoff valve 488 may be connected to a branch of the upper flow cross 460*u*. A lower end of a bypass hose 481 may be connected to the shutoff valve 488 and an upper end of the bypass hose 481 may be connected to a piped portion 31*p* of the bypass line 31*p,h* instead of the bypass hose 31*h*. A lower end of an auxiliary returns line 479 may be connected to a branch of the lower flow cross 460*b* and an upper end of the auxiliary returns line may be connected to a lower end of the returns line 29.

In operation, each flow sub 400 may be located along the drill string 410/stand (not shown) such that when the spider is engaged with the drill string, one of the flow subs 400 may be aligned with the UMRP 450. The alignment may ensure that when the BOPs 455*a,b* engage (and RCD 26 already engaged) the flow sub 400, the hydraulic port 433 is disposed in the vent chamber 465*v* and the side port 401 is disposed in the injection chamber 465*i*. Drilling fluid 60*d* pumped into the injection chamber 465*i* via the bypass line 31*p*, 481 may serve the dual purpose of opening the side port valve 420 and flowing through the side port 401 to maintain circulation of drilling fluid in the wellbore 90 while the additional stand to the drill string 410. Injection of the drilling fluid 60*d* may pressurize the opener chamber 435*o* via the side port 401 and hydraulic passage 434 while the closer chamber 435*c* is maintained at annulus pressure by fluid communication with the vent chamber 465*v* via the hydraulic port 433. Once pressure in the opener chamber 435*o* exerts fluid force on the piston 431 sufficient to overcome a combination of the spring force and fluid force in the closer chamber 435*c* exerted by annulus pressure, the sleeve 421 may move upward to the open position.

Alternatively, an RCD may be used instead of each BOP 455*a,b*, thereby allowing the flow sub 400 to be rotated while adding the stand to the drill string 410. Instead of a spider, the drilling rig 1*r* may include a rotary table for rotating the drill string 410 as the stand is being added by the top drive 5. The PLC 75 may synchronize rotation between the top drive 5 and the rotary table to effect continuous rotation while adding the stand to the drill string 10. Equipment suitable for use with such a continuous rotating drilling system is illustrated at FIG. 5A of US Pat. Pub. App. No. 2011/0155379, which is herein incorporated by reference in its entirety. Alternatively, instead of using additional RCDs, the flow sub 400 may be modified to include a rotary swivel as also discussed and illustrated in the '379 publication.

While the foregoing is directed to embodiments of the present invention, other and further embodiments of the invention may be devised without departing from the basic scope thereof, and the scope thereof is determined by the claims that follow.

The invention claimed is:

1. A method for drilling a wellbore, comprising:

disposing a tubular string in the wellbore, wherein the tubular string includes a drill bit disposed at a bottom and a flow sub disposed on a top;

injecting drilling fluid through a bore valve in the flow sub to rotate the drill bit;

moving a sleeve in the flow sub to engage and close the bore valve;

moving the sleeve independently from the bore valve to expose a flow port formed through a wall of the flow sub; and injecting the drilling fluid into the flow port while adding a stand to the top of the tubular string, wherein injection of drilling fluid into the tubular string is continuously maintained between drilling and adding the stand to the tubular string.

2. The method of claim 1, further comprising:

after adding the stand to the tubular string, moving the sleeve to close the flow port and open the bore valve; and resuming rotating the drill bit after closing the flow port.

3. The method of claim 2, wherein moving the sleeve comprises operating an actuator.

4. The method of claim 3, further comprising:

engaging the tubular string with a clamp before moving the sleeve to expose the flow port;

injecting drilling fluid into the flow port via an inlet of the clamp; and disengaging the clamp from the tubular string after adding the stand to the tubular string.

5. The method of claim 4, wherein engaging the tubular string with the clamp comprises simultaneously engaging the tubular string with a body of the clamp and engaging the sleeve with an actuator of the clamp.

6. The method of claim 3, wherein moving the sleeve comprises moving the sleeve from an exterior of the tubular string.

7. The method of claim 2, wherein moving the sleeve comprises operating an actuator in the tubular string.

8. The method of claim 7, further comprising:

engaging the tubular string with a clamp;

powering the actuator with the clamp prior to moving the sleeve; and disengaging the clamp from the tubular string.

9. The method of claim 7, wherein:

providing fluid communication to the actuator through the flow port; and injecting drilling fluid to operate the actuator.

10. The method of claim 1, wherein the drilling fluid is injected through the bore valve at a first flow rate to rotate the drill bit, and the drilling fluid is injected into the flow port at a second flow rate.

11. The method of claim 10, further comprising:

measuring the first flow rate while drilling the wellbore;

measuring the second flow rate while injecting the drilling fluid into the flow port;

measuring a flow rate of returning drilling fluid while drilling and while injecting the drilling fluid into the flow port; and comparing the flow rate of returning drilling fluid to the first flow rate while drilling the wellbore and to the second flow rate while injecting drilling fluid into the flow port to control pressure applied to an exposed formation adjacent to the wellbore.

12. The method of claim 10, wherein the first flow rate is greater than the second flow rate.

* * * * *